US009622306B2

(12) United States Patent
Chung et al.

(10) Patent No.: US 9,622,306 B2
(45) Date of Patent: Apr. 11, 2017

(54) LED LIGHTING CIRCUIT

(71) Applicant: City University of Hong Kong, Kowloon (HK)

(72) Inventors: Shu Hung Henry Chung, Scenecliff (HK); Rui Hong Zhang, Kowloon (HK)

(73) Assignee: City University of Hong Kong, Hong Kong (HK)

( * ) Notice: Subject to any disclaimer, the term of this patent is extended or adjusted under 35 U.S.C. 154(b) by 0 days.

(21) Appl. No.: 14/601,827

(22) Filed: Jan. 21, 2015

(65) Prior Publication Data

US 2016/0212810 A1 Jul. 21, 2016

(51) Int. Cl.
*H05B 37/00* (2006.01)
*H05B 41/00* (2006.01)
*H05B 33/08* (2006.01)

(52) U.S. Cl.
CPC ..... *H05B 33/0824* (2013.01)

(58) Field of Classification Search
None
See application file for complete search history.

(56) References Cited

U.S. PATENT DOCUMENTS 6,369,525 B1 4/2002 Chang et al.
2009/0195169 A1 8/2009 Huang et al.
2011/0006604 A1 1/2011 Chang et al.
2011/0018463 A1* 1/2011 Lin ..... H05B 33/0809 315/294
2012/0019156 A1* 1/2012 Jin ..... G09G 3/342 315/187
2013/0307427 A1* 11/2013 Liang ..... H05B 37/02 315/201
2015/0145426 A1* 5/2015 Zhong ..... H05B 33/0827 315/192
2015/0163882 A1* 6/2015 Zhang ..... H05B 33/0887 372/38.01

OTHER PUBLICATIONS

PHILIPS LUMILEDS, "Luxeon Rebel," Technical Datasheet DS63, pp. 1-34, 2012.
C. L. Chiu and K. H. Chen, "A High Accuracy Current-Balanced Control Technique for LED Backlight," in Proc. IEEE Power Electron. Spec. Conf., pp. 4202-4206, 2008.
E. Fred Schubert, "Light-Emitting Diodes," Cambridge University Press, pp. 216-218, 2006.

(Continued)

*Primary Examiner* — Anh Tran
(74) *Attorney, Agent, or Firm* — Renner Kenner; Greive Bobak; Taylor & Weber

(57) ABSTRACT

An LED lighting circuit includes a first node and a second node adapted to couple with an AC input power source; and an LED circuit loop having a plurality of LED light strings each having one or more LED light elements, the LED circuit loop defines a closed loop arranged between the first node and the second node and is connected to the first node and the second node respectively through a capacitive arrangement such that the LED light strings in the LED circuit loop is arranged to be driven with DC power while AC power provided by the AC input power source is transmitted between the first and second nodes.

32 Claims, 22 Drawing Sheets

(56) References Cited

OTHER PUBLICATIONS

A. Zukauskas, M. S. Shur and R. Gaska, "Introduction to Solid-State Lighting," Wiley-Interscience, New York, pp. 79-82, 2002.
M. Khatib, "Ballast Resistor Calculation—Current Matching in Parallel LEDs," Application Report SLVA325, Texas Instruments, Dallas, TX, pp. 1-8, 2009.
X. K. Wu, J. M. Zhang and M. Q. Zhao, "A Simple Two-Channel LED Driver with Automatic Precise Current Sharing," IEEE Trans. Ind. Electron., vol. 58, No. 10, pp. 4783-4788, Oct. 2011.
C. Zhao, X. Xie and S. Liu, "Multioutput LED Drivers with Precise Passive Current Balancing," IEEE Trans. Power Electron., vol. 28, No. 3, pp. 1438-1448, Mar. 2013.
Y. Yu, F. Zhang and J. Ni, "Capacitor Clamped Current-Sharing Circuit for Multistring LEDs," IEEE Trans. Ind. Electron. , vol. 61, No. 5, pp. 2423-2431, May 2014.
S. Choi and T. Kim, "Symmetric Current-Balancing Circuit for LED Backlight with Dimming," IEEE Trans. Ind. Electron., vol. 59, No. 4, pp. 1698-1707, Apr. 2012.
K. H. Loo, Y. M. Lai and Chi K. Tse, "Design and Analysis of LCC Resonant Network for Quasi-Lossless Current Balancing in Multistring AC-LED Array," IEEE Trans. Power Electron., vol. 28, No. 2, pp. 1047-1059, Feb. 2013.
W. Thomas and J. Pforr, "A novel low-cost current-sharing method for automotive LED-lighting systems," in 13th European Conference on Power Electronics and Applications, pp. 1-10, Sep. 2009.
J. Zhang, L. Xu, X. Wu and Z. Qian, "A Precise Passive Current Balancing Method for Multioutput LED Drivers," IEEE Trans. Power Electron., vol. 26, No. 8, pp. 2149-2159, Aug. 2011.
X. Wu, C. Hu, J. Zhang and C. Zhao, "Series-Parallel Autoregulated Charge-Balancing Rectifier for Multiouput Light-Emitting Diode Driver," IEEE Trans. Power Electron., vol. 61, No. 3, pp. 1262-1268, Mar. 2014.
K. I. Hwu, W. C. Tu and M. J. Hong, "A Dimmable LED Driver Based on Current Balancing Transformer with Magnetizing Energy Recycling Considered," Journal of Display Technology, vol. 10, No. 5, pp. 388-395, May 2014.
J. M. Zhang, J. F. Wang and X. K. Wu "A Capacitor-Isolated LED Driver with Inherent Current Balance Capability," IEEE Trans. Ind. Electron., vol. 59, No. 4, pp. 1708-1706, Apr. 2012.
Y. Hu and M. M. Jovanovic, "A New Current-Balancing Method for Paralleled LED Strings," in Proc. 26th Applied Power Electron. Conf. and Expo. (APEC), pp. 705-712, Mar. 2011.
R. Zhang and H. Chung, "Use of Daisy-Chained Transformers for Current Balancing Multiple LED Strings," IEEE Trans. Power Electron., vol. 29, No. 3, pp. 1418-1433, Mar. 2014.
R. Zhang and H. Chung, "Transformer-Isolated Resonant Driver for Parallel Strings with Robust Balancing and Stabilization of Individual LED Current," IEEE Trans. Power Electron., vol. 29, No. 7, pp. 3694-3708, Jul. 2014.
R. Zhang and H. Chung, "Capacitor-Isolated Multi-String LED Driver with Daisy-Chained Transformers," IEEE Trans. Power Electron, vol. 30, No. 7, pp. 3860-3875, Jul. 2015.
R. Zhang and H. Chung, "A Parallel LED String Driver Using Capacitors for Source and String Ground Separation," in IEEE Energy Conversion Congress and Exposition, Pittsburgh, PA, USA, Sep. 2014.
H. J. Chiu and S. J. Cheng, "LED Backlight Driving System for Large-Scale LCD Panels," IEEE Trans. Ind. Electron., vol. 54, No. 5, pp. 2751-2760, Oct. 2007.
S. N. Li, W. X. Zhong, W. Chen and S. Y. R. Hui, "Novel Self-Configurable Current-Mirror Techniques for Reducing Current Imbalance in Parallel Light-Emitting Diode (LED) Strings," IEEE Trans. Power Electron., vol. 27, No. 4, pp. 2153-2162, Apr. 2012.
S. N. Li and S. Y. R. Hui, "Self-Configurable Current-Mirror Circuit with Short-Circuit and Open-Circuit Fault Tolerance for Balancing Parallel Light-Emitting Diode (LED) String Currents," IEEE Trans. Power Electron., vol. 29, No. 10, pp. 5498-5507, Oct. 2014.
Y. Hu and M. M. Jovanovic, "LED Driver with Self-Adaptive Drive Voltage," IEEE Trans. Power Electron., vol. 23, No. 6, pp. 3116-3125, Nov. 2008.
X. Qu, S. C. Wong, and C. K. Tse, "A Current Balancing Scheme with High Luminous Efficacy for High-Power LED Lighting," IEEE Trans. Power Electron., vol. 29, No. 6, pp. 2649-2654, Jun. 2014.
H. J. Chiu, Y. K. Lo, J. T. Chen, S. J. Cheng, C. Y. Lin and S. C. Mou, "A High Efficiency Dimmable LED Driver for Low-Power Lighting Applications," IEEE Trans. Ind. Electron., vol. 57, No. 2, pp. 735-743, Feb. 2010.
W. Chen and S. Y. R. Hui, "A Dimmable Light-Emitting Diode (LED) Driver With Mag-Amp Postregulators for Multistring Applications," IEEE Trans. Power Electron., vol. 26, No. 6, pp. 3116-3125, Jun. 2011.
K. I. Hwu and Y. T. Yau, "Applying One-Comparator Counter-Based Sampling to Current Sharing Control of Multichannel LED Strings," IEEE Trans. Ind. Appl., vol. 47, No. 6, pp. 2413-2421, Nov./Dec. 2012.
Q. Hu and R. Zane, "LED Driver Circuit with Series-Input-Connected Converter Cells Operating in Continuous Conduction Mode," IEEE Trans. Power Electron., vol. 25, No. 3, pp. 574-582, Mar. 2010.

* cited by examiner

1500A

1500B

1500C

LED current: 300mA

LED current: 210mA

LED current: 120mA

LED current: 30mA

Design Specifications

| Parameter | Value | Parameter | Value |
|---|---|---|---|
| $v_{LS}$ | 27V | $i_{LS}$ | 300mA |
| $f_{s,min}$ | 80kHz | $N$ | 10 |
| $V_{dc}$ | 110V | $f_c$ | 35kHz |
| $\Delta v_{max}$ | 0.15% of $V_{LS}$ | $\Delta i_{L_{f,k}}$ | 13% of $i_{LBD}$ |

Note: $V_{DS}$ is the rated drain source voltage of $S_1$ and $S_2$.

FIG.21

Component values used in the prototype

| Component | Value | Component | Value |
|---|---|---|---|
| $L_r$ | 60μH | $C_{1k}$ and $C_{2k}$ | 22nF (Ceramic cap) |
| $L_{f,k}$ | 2μH | $C_{f,k1}$ and $C_{f,k2}$ | 10μF (Ceramic cap) |
| $D_{A,k}$, $D_{B,k}$, $D_{C,k}$ and $D_{D,k}$ | SB1100 | $S_1$ and $S_2$ | IRFB5620PBF |

Note: $k = 1, 2, \ldots, 10$

FIG.22

$i_{LS,k}$ and $v_{LS,k}$ at the rated current of 300mA

| String $k$ | $i_{LS,k}$ (mA) | Variation of $i_{LS,k}$ (%) | $v_{LS,k}$ (V) | Variation of $v_{LS,k}$ (%) |
|---|---|---|---|---|
| 1 | 300 | 0.10 | 0.979 | -92.74 |
| 2 | 300 | 0.10 | 27.6 | 104.67 |
| 3 | 300 | 0.10 | 6.67 | -50.54 |
| 4 | 299 | -0.23 | 25.6 | 89.84 |
| 5 | 300 | 0.10 | 6.43 | -52.32 |
| 6 | 300 | 0.10 | 18.4 | 36.45 |
| 7 | 300 | 0.10 | 10.01 | -25.77 |
| 8 | 299 | -0.23 | 21.8 | 61.66 |
| 9 | 299 | -0.23 | 13.69 | 1.52 |
| 10 | 300 | 0.10 | 3.673 | -72.76 |

FIG.23

Measured results of $i_{LS,k}$ and $v_{LS,k}$ at 210mA (i.e., 70% of the rated current)

| String $k$ | $i_{LS,k}$ (mA) | Variation of $i_{LS,k}$ (%) | $v_{LS,k}$ (V) | Variation of $v_{LS,k}$ (%) |
|---|---|---|---|---|
| 1 | 211 | 0.48 | 0.939 | -92.69 |
| 2 | 210 | 0 | 27.3 | 112.44 |
| 3 | 210 | 0 | 6.75 | -47.47 |
| 4 | 210 | 0 | 24.01 | 86.84 |
| 5 | 210 | 0 | 6.23 | -51.52 |
| 6 | 210 | 0 | 16.925 | 31.70 |
| 7 | 209 | -0.48 | 10.3 | -19.85 |
| 8 | 210 | 0 | 19.65 | 52.91 |
| 9 | 210 | 0 | 12.98 | 1.00 |
| 10 | 210 | 0 | 3.425 | -73.35 |

FIG.24

Measured results of $i_{LS,k}$ and $v_{LS,k}$ at 120mA (i.e., 40% of the rated current)

| String $k$ | $i_{LS,k}$ (mA) | Variation of $i_{LS,k}$ (%) | $v_{LS,k}$ (V) | Variation of $v_{LS,k}$ (%) |
|---|---|---|---|---|
| 1 | 120 | 0.42 | 0.836 | -93.14 |
| 2 | 120 | 0.42 | 25.43 | 108.56 |
| 3 | 119 | -0.42 | 6.42 | -47.35 |
| 4 | 119 | -0.42 | 22.1 | 81.25 |
| 5 | 119 | -0.42 | 6.17 | -49.40 |
| 6 | 120 | 0.42 | 15.83 | 29.83 |
| 7 | 120 | 0.42 | 9.62 | -21.10 |
| 8 | 119 | -0.42 | 19.73 | 61.81 |
| 9 | 120 | 0.42 | 12.622 | 3.52 |
| 10 | 119 | -0.42 | 3.172 | -73.99 |

FIG.25

Measured results of $i_{LS,k}$ and $v_{LS,k}$ at 30mA (i.e., 10% of the rated current)

| String $k$ | $i_{LS,k}$ (mA) | Variation of $i_{LS,k}$ (%) | $v_{LS,k}$ (V) | Variation of $v_{LS,k}$ (%) |
|---|---|---|---|---|
| 1 | 30.1 | 0.47 | 0.567 | -94.75 |
| 2 | 30 | 0.13 | 22.64 | 109.79 |
| 3 | 30 | 0.13 | 5.62 | -47.92 |
| 4 | 29.8 | -0.53 | 19.63 | 81.89 |
| 5 | 30.1 | 0.47 | 6.14 | -43.11 |
| 6 | 29.9 | -0.20 | 14.15 | 31.12 |
| 7 | 30 | 0.13 | 8.34 | -22.72 |
| 8 | 29.9 | -0.20 | 16.78 | 55.49 |
| 9 | 29.8 | -0.53 | 11.24 | 4.15 |
| 10 | 30 | 0.13 | 2.813 | -73.93 |

FIG.26

Values of Capacitors used in each LED Strings

| String | 1 | 2 | 3 | 4 | 5 | 6 | 7 | 8 | 9 | 10 |
|---|---|---|---|---|---|---|---|---|---|---|
| $C_{1,k}$(nF) | 2.2 | 6.6 | 11.6 | 16.3 | 22 | 26.7 | 31.4 | 36.1 | 44 | 48.7 |
| $C_{2,k}$(nF) | 50.6 | 2.2 | 25.3 | 44 | 36.1 | 6.6 | 17.4 | 22 | 8.8 | 31.4 |

FIG.27

LED LIGHTING CIRCUIT

TECHNICAL FIELD

The present invention relates to an LED lighting circuit, and particularly, although not exclusively, to a ring diode-capacitor circuit arrangement for balancing currents in a plurality of LED strings each having one or more LED lights.

BACKGROUND

With the rapid development of solid-state lighting technology, high-brightness light emitting diodes (LEDs) have been widely used in many lighting equipment, such as street lightings, LED-backlit LCD displays, etc. High-power LED lamps typically consist of multiple parallel-connected LED strings each having one or more series-connected low-power LEDs. Due to considerable tolerance in the voltage-current characteristics of LEDs and the linear relationship between the luminous output and the LED current, it is often important to operate the LED strings with the same current so as to ensure uniform luminous output from the LED strings.

Current-balancing techniques for balancing current through different LED strings in LED circuits can be broadly classified as passive techniques and active techniques. Generally, passive techniques are commonly based on using passive circuit components, such as resistors, capacitors, inductors, and transformers, to balance the string currents; while active techniques are commonly based on using active circuit devices to control the string currents. In terms of circuit complexity, passive techniques are generally simpler compared with active techniques as they normally require only one main switching network. Therefore, passive techniques are more preferable over active techniques in some applications.

Nevertheless, existing current balancing techniques are not without problems. For example, in one technique based on inserting a resistor in series with each string, the resistors may readily introduce energy loss in the circuit and this type of technique is often less suitable for applications requiring dimming function. In some other techniques, the reactive power and circulating energy in the LED driver may be substantial and hence not desirable. In yet some other techniques, such as those using transformers, the need of an additional energy-recycling or feedback network as well as the cost and physical size of the circuits are problematic.

SUMMARY OF THE INVENTION

In accordance with a first aspect of the present invention, there is provided an LED lighting circuit comprising a first node and a second node adapted to couple with an AC input power source; and an LED circuit loop having a plurality of LED light strings each having one or more LED light elements, the LED circuit loop defining a closed loop arranged between the first node and the second node and is connected to the first node and the second node respectively through a capacitive arrangement such that the LED light strings in the LED circuit loop is arranged to be driven with DC power while AC power provided by the AC input power source is transmitted between the first and second nodes. Preferably, the current through each of the plurality of LED light strings are substantially balanced such that the values of the currents are substantially the same. The number of LED light elements in each LED light strings may be the same or different.

In one embodiment of the first aspect, the LED circuit loop further comprises a plurality of rectifier circuits connected in series with the plurality of LED light strings. The rectifier circuits ensure a DC power is flowing through the LED circuit loop when AC power is transmitted between the first and second nodes. In a specific embodiment, one LED light string is connected between two adjacent rectifier circuits, and one rectifier circuit is connected between two adjacent LED light elements in the LED circuit loop.

In one embodiment of the first aspect, the capacitive arrangement is arranged to provide galvanic isolation to the LED circuit loop such that the LED circuit loop is galvanically isolated from the first and second nodes.

In one embodiment of the first aspect, the capacitive arrangement comprises a plurality of first capacitors connected in parallel between the first node and the LED circuit loop; and a plurality of second capacitors connected in parallel between the second node and the LED circuit loop. The capacitances of the plurality of first capacitors and the plurality of second capacitors may be the same or may be different, as long as the current balancing effect remains effective.

In one embodiment of the first aspect, the plurality of first capacitors and the plurality of second capacitors are arranged to be charged and discharged alternately through the LED light strings as AC power is transmitted between the first and second nodes.

In one embodiment of the first aspect, each of the plurality of first capacitors and each of the plurality of second capacitors are arranged to be charged and discharged alternately through different LED light strings in the LED lighting circuit as AC power provided by the AC input power source is transmitted from the first node to the second node and from the second node to the first node.

In one embodiment of the first aspect, a bypass element is connected across one or more of the LED light elements in the LED light strings to provide a bypass path when the one or more LED light element fails.

In one embodiment of the first aspect, the bypass element comprises a thyristor. Yet in some embodiments, other bypass element may also be used.

In one embodiment of the first aspect, a filter circuit is connected across one or more of the LED light strings to reduce current ripple in the one or more LED light strings.

In one embodiment of the first aspect, the filter circuit comprises a capacitor-input filter. The capacitor-input filter is preferably a CLC circuit.

In one embodiment of the first aspect, the AC power provided by the AC input power source comprises an AC current with positive and negative half cycles. The AC current is preferably sinusoidal, and it may or may not be offset by a certain phase angle.

In one embodiment of the first aspect, the rectifier circuit comprises a diode bridge. The diode bridge preferably includes four diodes, but may be varied to have more than or less than four diodes in some embodiments.

In one embodiment of the first aspect, at least one LED light string is connected between two adjacent diode bridges in the LED circuit loop. The LED light elements are biased in the same direction as the diodes in the diode bridge.

In one embodiment of the first aspect, each of the plurality of first capacitors is connected between the first node and a respective diode bridge; and each of the plurality of second capacitors is connected between the second node and a respective diode bridge, such that each diode bridge is coupled with the first node through a respective one of the plurality of first capacitors and with the second node through a respective one of the plurality of second capacitors.

In one embodiment of the first aspect, a plurality of first flow paths are defined from the first node to the second node during positive half cycle of the AC power provided by the AC input power source, and a plurality of second flow paths are defined from the second node to the first node during a negative half cycle of the AC power provided by the AC input power source.

In one embodiment of the first aspect, the plurality of first and second flow paths are arranged to power the LED light strings in the LED circuit loop as AC power is transmitted between the first and second nodes.

In one embodiment of the first aspect, each LED light string is powered by a respective one of the plurality of first capacitors and a respective one of the plurality of second capacitors as AC power is transmitted from the first node to the second node, and is powered by another respective one of the plurality of first capacitors and another respective one of the plurality of second capacitors in the second flow path as AC power is transmitted from the second node to the first node.

In one embodiment of the first aspect, each of the first flow path is defined from the first node, through a respective one of the plurality of first capacitors, a diode bridge connected directly with the respective one of the plurality of first capacitors, at least one LED light string connected between the diode bridge and an adjacent diode bridge, the adjacent diode bridge, a respective one of the plurality of second capacitors connected directly with the adjacent diode bridge, to the second node. Preferably, each first flow path involves only one diode in each of the diode bridges (i.e. only one of the diodes in the diode bridge belongs to the first flow path).

In one embodiment of the first aspect, each of the second flow path is defined from the second node, through a respective one of the plurality of second capacitors, a diode bridge connected directly with the respective one of the plurality of second capacitors, at least one LED light string connected between the diode bridge and an adjacent diode bridge, the adjacent diode bridge, a respective one of the plurality of first capacitors connected directly with the adjacent diode bridge, to the first node. Preferably, each second flow path involves only one diode in each of the diode bridges (i.e. only one of the diodes in the diode bridge belongs to the second flow path), and these diodes are different from those in the first flow path.

In one embodiment of the first aspect, the rectifier circuit comprises a diode. The LED light elements in the LED light strings are preferably biased in the same direction as the diodes.

In one embodiment of the first aspect, at least one LED light string is connected between two adjacent diodes in the LED circuit loop.

In one embodiment of the first aspect, each of the plurality of first capacitors is connected between the first node and a respective diode, and each of the plurality of second capacitors is connected between a respective diode and the second node; wherein each diode is connected directly with only one of the plurality of first capacitors or one of the plurality of second capacitors but preferably not to both.

In one embodiment of the first aspect, a plurality of first flow paths are defined from the first node to the second node during positive half cycle of the AC power provided by the AC input power source, and a plurality of second flow paths are defined from the second node to the first node during a negative half cycle of the AC power provided by the AC input power source.

In one embodiment of the first aspect, each of the first flow path is defined from the first node, through a respective one of the plurality of first capacitors, a diode connected directly with the respective one of the plurality of first capacitors, at least one LED light string connected to the diode, a respective one of the plurality of second capacitors connected directly with the at least one LED light string, to the second node.

In one embodiment of the first aspect, each of the second flow path is defined from the second node, through a respective one of the plurality of second capacitors, a diode connected directly with the respective one of the plurality of second capacitors, at least one LED light string connected to the diode, a respective one of the plurality of first capacitors connected directly with the at least one LED light string, to the first node. Preferably, the diodes involved in the second flow path are not the same as those involved in the first flow path. In other words, the diodes can be broadly classified as two groups, one group belongs to the first flow path, the other group belongs to the second flow path.

In one embodiment of the first aspect, a third flow path is defined from the first node to the second node, through one of the plurality of first capacitors, a diode connected directly with the one of the plurality of first capacitors, at least one LED light string, another diode connected to the at least one LED light string, at least one another LED light string connected to the another diode, and one of the plurality of second capacitors connected directly with the at least one another LED light string. Preferably, the third flow path is present in the LED lighting circuit when there is an odd number of capacitor (sum of number of first and second capacitors is odd number) in the LED lighting circuit. In a preferred embodiment, the third flow path is present when there are an even number of second capacitors and an odd number of first capacitors.

In one embodiment of the first aspect, a fourth flow path is defined from the second node to the first node, through one of the plurality of second capacitors, a diode connected directly with the one of the plurality of second capacitors, at least one LED light string connected with the diode, another diode connected to the at least one LED light string, at least one another LED light string connected to the another diode, and one of the plurality of first capacitors connected directly with the at least one another LED light string. Preferably, the fourth flow path is present in the LED lighting circuit when there is an odd number of capacitor (sum of number of first and second capacitors is odd number) in the LED lighting circuit. In a preferred embodiment, the fourth flow path is present when there are an odd number of second capacitors and an even number of first capacitors.

In a preferred embodiment of the first aspect, currents in each of the LED light string are balanced during operation of the LED lighting circuit such that the currents are of the same value.

In accordance with a second aspect of the present invention, there is provided a driver circuit for driving an LED lighting circuit, wherein the driver circuit is arranged to be connected between a power source and an LED lighting circuit for regulating power transmitted from the power source to the LED lighting circuit, and the driver circuit comprises one or more switching devices adapted to be connected in series with the power source, and an output across one of the one or more switching devices is arranged to act as an input to the LED lighting circuit. Preferably, the LED lighting circuit is the LED lighting circuit in accordance with the first aspect of the present invention.

In one embodiment of the second aspect, the switching devices are MOSFET devices.

In one embodiment of the second aspect, the driver circuit further comprising a series inductor connected between the one of the switching devices and the LED lighting circuit.

In one embodiment of the second aspect, each of the one or more switching devices is connected with a parallel capacitor.

In one embodiment of the second aspect, each of the one or more switching devices is connected with a parallel diode. Preferably, the parallel diode is also connected in parallel with the parallel capacitor.

In one embodiment of the first aspect, the driver circuit further comprises an input current determination means arranged to determine the amount of current transmitted into the LED lighting circuit. Preferably, the input current determination means comprises a transformer circuit connected with a microcontroller, and the input current determination means is coupled with a current line in the driver circuit for determining the amount of current provided by the power source to the LED lighting circuit.

In one embodiment of the second aspect, the drive circuit further comprising a controller connected with the one or more switching devices for controlling a switching frequency and/or a duty cycle of the one or more switching devices so as to alter an amount of power provided to the LED lighting circuit. Preferably, switching frequency and/or a duty cycle control is based on the amount of current determined by the input current determination means.

In one embodiment of the second aspect, the controller comprises a microprocessor.

In one embodiment of the second aspect, the power source is a DC power source.

In accordance with a third aspect of the present invention, there is provided a method for operating a driver circuit connected between a power source and a LED lighting circuit, the method comprising the steps of determining a current flowing from the driver circuit to the LED lighting circuit using an input current determination means arranged in the driver circuit; comparing the current determined with one or more predetermined values; and adjusting a switching frequency and/or a duty cycle of the switching devices of the driver circuit based on the comparing result so as to regulate power transmitted form the power source to the LED lighting circuit. Preferably, the LED lighting circuit is the LED lighting circuit in accordance with the first aspect of the present invention; and the driver circuit is the driver circuit in accordance with the second aspect of the present invention.

In one embodiment of the third aspect, the step of determining a current flowing from the driver circuit to the LED lighting circuit comprises sampling a current flowing from the driver circuit to the LED lighting circuit.

In one embodiment of the third aspect, the step of comparing the current determined with one or more predetermined values comprises: comparing whether the current determined is above or below predetermined upper and lower current limits; whereupon determining that the current is below the predetermined lower current limit, reduce the switching frequency and adjust the duty cycle to a default value; whereupon determining that the current is within the predetermined upper and lower current limits, maintain the switching frequency and adjust the duty cycle to the default value; and whereupon determining that the current is above the predetermined upper current limit, determine if the switching frequency of the switching devices is above a threshold switching frequency to determine an extent of which the switching frequency and/or the duty cycle should be adjusted.

In one embodiment of the third aspect, whereupon determining that the switching frequency of the switching devices is above the threshold switching frequency, determine if the duty cycle of the switching devices is above a threshold duty cycle value to determine the extent of which the duty cycle should be adjusted; and whereupon determining that the switching frequency of the switching devices is below the threshold switching frequency, increase the switching frequency and adjust the duty cycle to the default value.

In one embodiment of the third aspect, whereupon determining that the duty cycle of the switching devices is above the threshold duty cycle value, adjust the switching frequency to the threshold switching frequency and reduce the duty cycle; and whereupon determining that the duty cycle of the switching devices is below the threshold duty cycle value, adjust the switching frequency to the threshold switching frequency and adjust the duty cycle to the threshold duty cycle value.

In one embodiment of the third aspect, the default value of the duty cycle is 0.5.

In one embodiment of the third aspect, the threshold duty cycle value is a minimum duty cycle determined by a voltage of the power source and an equivalent voltage across the LED lighting strings in the LED lighting circuit.

In one embodiment of the third aspect, the threshold switching frequency is a maximum switching frequency of the switching devices.

In one embodiment of the third aspect, the switching devices are MOSFET devices.

In accordance with a fourth aspect of the present invention, there is provided a lighting equipment comprising the LED lighting circuit in accordance with the first aspect of the present invention.

BRIEF DESCRIPTION OF THE DRAWINGS

Embodiments of the present invention will now be described, by way of example, with reference to the accompanying drawings in which:

FIG. 21 is a table showing the design specifications of the prototype circuit of FIGS. 16A-16C;

FIG. 22 is a table showing the specifications of the components used in the prototype circuit of FIGS. 16A-16C;

FIG. 23 is a table showing the measurement results of the currents, voltages and their variations in different LED strings in the prototype circuit of FIGS. 16A-16C at the rated current of 300 mA;

FIG. 24 is a table showing the measurement results of the currents, voltages and their variations in different LED strings in the prototype circuit of FIGS. 16A-16C at the rated current of 210 mA;

FIG. 25 is a table showing the measurement results of the currents, voltages and their variations in different LED strings in the prototype circuit of FIGS. 16A-16C at the rated current of 120 mA;

FIG. 26 is a table showing the measurement results of the currents, voltages and their variations in different LED strings in the prototype circuit of FIGS. 16A-16C at the rated current of 30 mA; and FIG. 27 is a table showing the capacitance values of the capacitors used in different LED strings in the prototype of FIGS. 16A-16C.

DETAILED DESCRIPTION OF THE PREFERRED EMBODIMENT

LED Lighting Circuit

Referring to FIGS. 1-4, there is provided an LED lighting circuit comprising a first node and a second node adapted to couple with an AC input power source; and an LED circuit loop having a plurality of LED light strings each having one or more LED light elements, the LED circuit loop defining a closed loop arranged between the first node and the second node and is connected to the first node and the second node respectively through a capacitive arrangement such that the LED light strings in the LED circuit loop is arranged to be driven with DC power whilst AC power provided by the AC input power source is transmitted between the first and second nodes.

Figure 1:
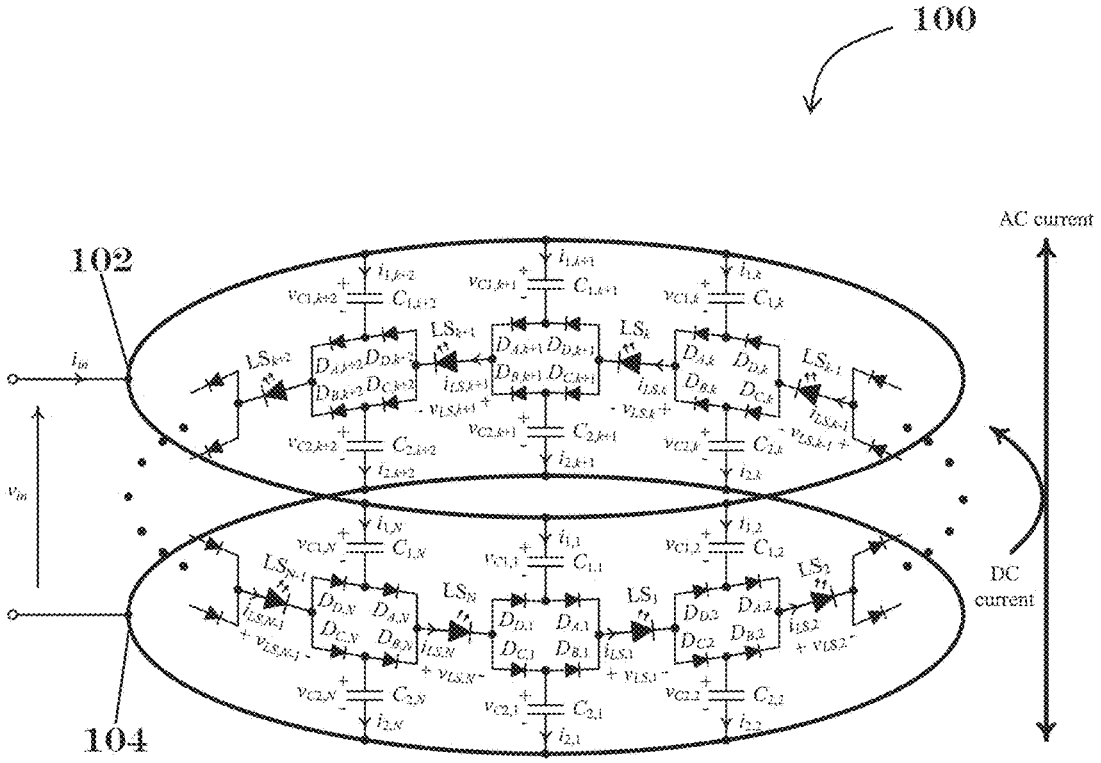
FIG. 1 shows an LED lighting circuit (in full wave configuration) for balancing currents in LED strings in accordance with a first embodiment of the present invention.

FIG. 1 shows an LED lighting circuit 100 for balancing currents in N LED strings ($LS_1$, $LS_2$, . . . , $LS_N$) in accordance with a first embodiment of the present invention. In this embodiment, N may be an even or odd number. Also, each LED strings may have one or more LED light elements, and different LED strings may have the same or different number of LED light elements. The circuit 100 in the present embodiment is in a full wave configuration, i.e. currents through the LED strings ($LS_1$, $LS_2$, . . . , $LS_N$) are full wave rectified.

In this first embodiment, the circuit 100 includes two nodes 102, 104 connected with a power supply (which may be, for example, provided by a driver circuit) providing an input voltage $v_{in}$ and an input current $i_{in}$. Preferably, the input current is a sinusoidal AC current that may or may not be offset by a certain phase angle. For illustration purposes, the nodes 102, 104 coupled with the power supply are each presented in the form of a loop or ring in FIG. 1 although they need not necessarily be in these forms. The circuit 100 also includes a number of LED strings ($LS_1$, $LS_2$, . . . , $LS_N$) connected in series with a number of diode bridges each formed by four diodes ($D_{A,k}$, $D_{B,k}$, $D_{C,k}$, $D_{D,k}$; k=1, 2, . . . , N). The LED strings ($LS_1$, $LS_2$, . . . , $LS_N$) and the diode bridges together form a closed loop or ring.

In the present embodiment, the diode bridges are operable to avoid possible reverse current flow due to short-circuit failure in any of the LED string ($LS_1$, $LS_2$, . . . , $LS_N$). Preferably, in the circuit 100, the LED string-diode bridge loop is connected to the nodes 102, 104 through a number of first capacitors $C_{1,k}$ (k=1, 2, . . . , N) and a number of second capacitors $C_{2,k}$ (k=1, 2, . . . , N) respectively. More particularly, all first capacitors $C_{1,k}$ (k=1, 2, . . . , N) are connected in parallel between node 102 and the diode bridges in the LED string-diode bridge loop; and all second capacitors $C_{2,k}$ (k=1, 2, . . . , N) are connected in parallel between the other node 104 and the diode bridges in the LED string-diode bridge loop. In other words, each of the diode bridge is connected to the nodes 102, 104 through one first capacitor and one second capacitor. The sum of the currents ($i_1$, . . . , $i_N$) through all the first and second capacitors $C_{1,k}$ and $C_{2,k}$ (k=1, 2, . . . , N) is equal to the input current $i_{in}$. In the present embodiment, the first and second capacitors $C_{1,k}$ and $C_{2,k}$ (k=1, 2, . . . , N) are operable to provide galvanic isolation between the power input (or driver circuit) and the LED strings ($LS_1$, $LS_2$, . . . , $LS_N$).

In the first embodiment, in order to maintain the current flowing through the LED string-diode bridge loop at all times during operation, each LED elements in the LED strings ($LS_1$, $LS_2$, . . . , $LS_N$) may be provided with different current paths for normal and failure condition. Although not specifically shown in FIG. 1, a bypass element such as a thyristor is preferably connected across each of the LED elements in the LED strings ($LS_1$, $LS_2$, . . . , $LS_N$) such that when an LED in the LED string-diode bridge loop fails, a bypass path is provided to bypass that failed LED element and the rest of the normal LED elements can continue to operate. In an alternative embodiment, not all of the LED elements in the LED strings are provided with a bypass element for bypass. A current ripple reduction means (not shown) may also be provided for each LED string in circuit 100. In one example, the current ripple reduction means is a pi-filter 1500 (e.g. CLC filter) as illustrated in FIG. 15.

At steady state, the average current of each capacitor $C_{1,k}$ and $C_{2,k}$ (k=1, 2, . . . , N) in the circuit 100 is zero. Thus, all LED strings ($LS_1$, $LS_2$, . . . , $LS_N$) have substantially the same DC current, irrespective of the LED string voltages ($v_{LS,1}$, $v_{LS,2}$, . . . , $v_{LS,N}$) and the capacitances of the capacitors $C_{1,k}$ and $C_{2,k}$ (k=1, 2, . . . , N). As illustrated in FIG. 1, the circuit 100 includes two main current paths during operation. The first path is the DC current path provided through the LED strings, and the second path is the AC current passing between the nodes 102, 104 through the first and second capacitors $C_{1,k}$ and $C_{2,k}$ (k=1, 2, . . . , N). The operation of the circuit 100 of FIG. 1 will be described in further detail with reference to FIGS. 5A-5B.

In the first embodiment as illustrated in FIG. 1, each LED string is 'sandwiched' between two adjacent diode bridges whereas each diode bridge is 'sandwiched' between two adjacent LED strings. However, in other embodiments, any combination or connection of the LED strings and the diode bridges are possible as long as they together define a closed loop. For example, more than one LED strings may be arranged between two adjacent diode bridges.

Figure 2:
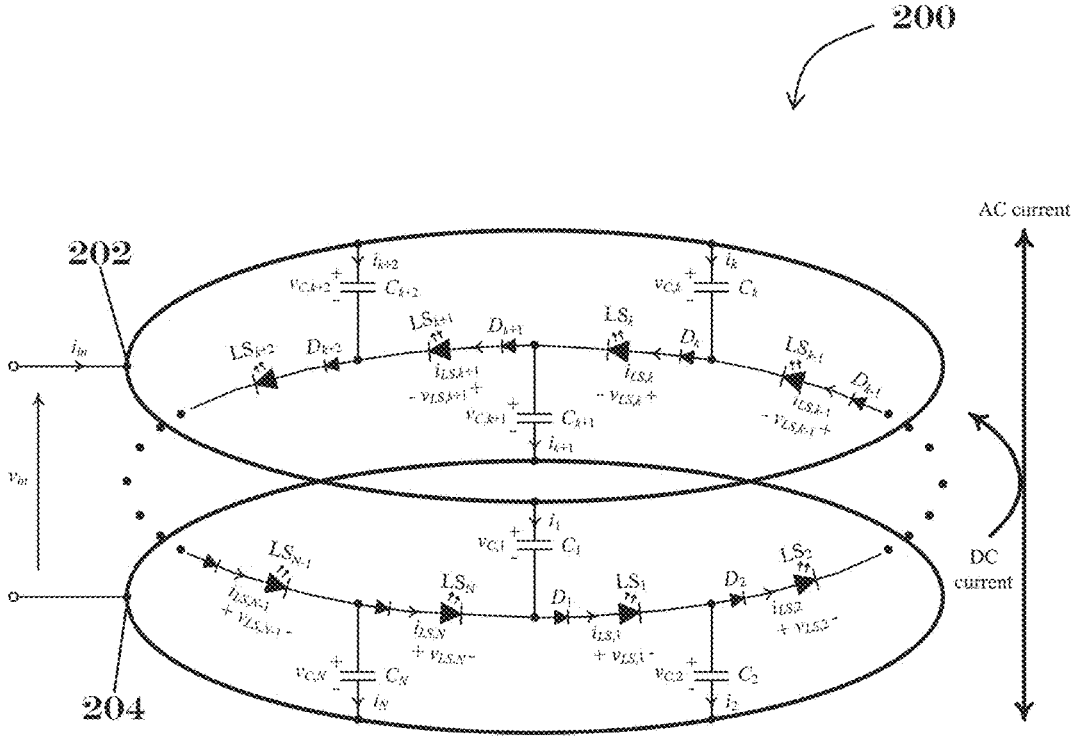
FIG. 2 shows an LED lighting circuit (in half wave configuration, with even number of LED strings) for balancing currents in LED strings in accordance with a second embodiment of the present invention.

FIG. 2 shows an LED lighting circuit 200 for balancing currents in N LED strings in accordance with a second embodiment of the present invention. In this second embodiment, N is an even number. Also, each LED strings may have one or more LED light elements, and different LED strings may have the same or different number of LED light elements. The circuit 200 in this second embodiment is in a half wave configuration, i.e. currents through the LED strings ($LS_1$, $LS_2$, . . . , $LS_N$) are half wave rectified.

In this second embodiment, the circuit 200 includes two nodes 202, 204 connected with a power supply (which may be, for example, provided by a driver circuit) providing an input voltage $v_{in}$ and an input current $i_{in}$. Preferably, the input current is a sinusoidal AC current that may or may not be offset by a certain phase angle. For illustration purposes, the nodes 202, 204 coupled with the power supply are each presented in the form of a loop or ring in FIG. 2. The circuit 200 in this second embodiment includes a number of LED strings ($LS_1$, $LS_2$, . . . , $LS_N$) connected in series with a number of diodes ($D_1$, $D_2$, . . . , $D_N$). The LED strings ($LS_1$, $LS_2$, . . . , $LS_N$) and the diodes ($D_1$, $D_2$, . . . , $D_N$) together form a closed loop or ring. In the present embodiment, the diodes ($D_1$, $D_2$, . . . , $D_N$) are operable to avoid possible reverse current flow due to short-circuit failure in any of the LED string ($LS_1$, $LS_2$, . . . , $LS_N$). Preferably, in the circuit 200, the LED string-diode loop is connected to the nodes 202, 204 through a number of first capacitors and second capacitors ($C_1$, $C_2$, . . . , $C_N$). More particularly, the first capacitors are the ones that connected in parallel between node 202 and the diodes in the LED string-diode loop; and the second capacitors are the ones that are connected in parallel between the other node 204 and the diodes in the LED string-diode loop.

In this embodiment, each of the diodes is connected directly with either the first capacitor or second capacitor, but not with both. More specifically, in the circuit 200, one diode is connected directly with one of the first capacitors and the next (immediate adjacent) diode is connected directly with one of the second capacitors, thus forming an alternating connection pattern. The sum of the currents ($i_1$, . . . , $i_N$) through all the first and second capacitors ($C_1$, $C_2$, . . . , $C_N$) is equal to the input current $i_{in}$. In the present embodiment, the first and second capacitors ($C_1$, $C_2$, . . . , $C_N$) are operable to provide galvanic isolation between the power input (or driver circuit) and the LED strings ($LS_1$, $LS_2$, . . . , $LS_N$).

In the second embodiment, in order to maintain the current flowing through the LED string-diode loop at all times during operation, each LED elements in the LED strings ($LS_1$, $LS_2$, . . . , $LS_N$) may be provided with different current paths for normal and failure condition. Although not specifically shown in the circuit 200 of FIG. 2, a bypass element such as a thyristor is preferably connected across each LED elements in the LED strings ($LS_1$, $LS_2$, . . . , $LS_N$) such that when an LED element in the LED string-diode loop fails, a bypass path is provided to bypass that failed LED element and the rest of the normal LED elements can continue to operate. In an alternative embodiment, not all of the LED elements in the LED strings are provided with a bypass element for bypass. A current ripple reduction means (not shown) may also be provided for each LED string in circuit 200. In one example, the current ripple reduction means is a pi-filter 1500 (e.g. CLC filter) as illustrated in FIG. 15.

At steady state, the average current of each capacitor ($C_1$, $C_2$ . . . , $C_N$) in the circuit 200 in this second embodiment is zero. Thus, all LED strings ($LS_1$, $LS_2$, . . . , $LS_N$) have substantially the same DC current, irrespective of the LED string voltages ($v_{LS,1}$, $v_{LS,2}$, . . . , $v_{LS,N}$) and the capacitances of the capacitors ($C_1$, $C_2$ . . . , $C_N$). As illustrated in FIG. 2, the circuit 200 includes two main current paths during operation. The first path is the DC current path provided through the LED strings, and the second path is the AC current path passing between the nodes 202, 204 through the first and second capacitors ($C_1$, $C_2$ . . . , $C_N$. The operation of the circuit 200 in FIG. 2 will be described in further detail with reference to FIGS. 6A-6B.

In the second embodiment as illustrated in FIG. 2, one LED string is 'sandwiched' between two adjacent diodes whereas one diode is 'sandwiched' between two adjacent LED strings. However, in other embodiments, any combination or connection of the LED strings and diodes are possible as long as they together define a closed loop. In one example, more than one LED string may be arranged between two diodes.

Figure 3:
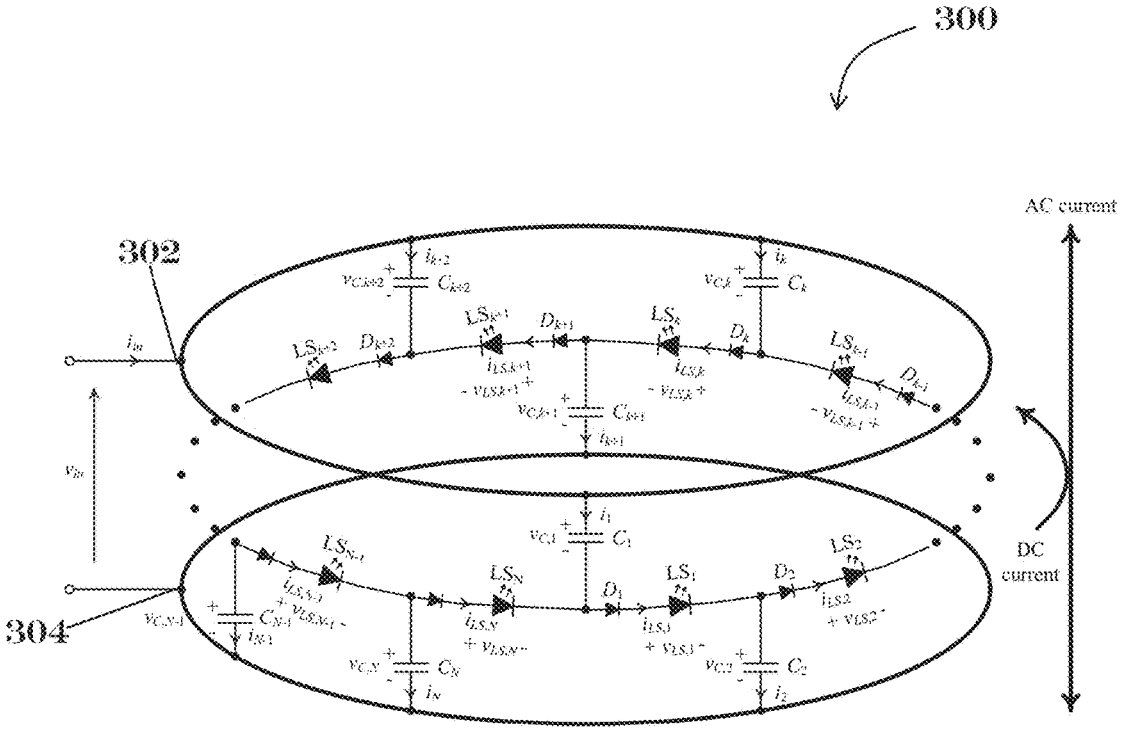
FIG. 3 shows an LED lighting circuit (in half wave configuration, with odd number of LED strings) for balancing currents in LED strings in accordance with a third embodiment of the present invention.

FIG. 3 shows an LED lighting circuit 300 for balancing currents in LED strings in accordance with a third embodiment of the present invention. In this third embodiment, N is an odd number. Also, each LED strings may have one or more LED light elements, and different LED strings may have the same or different number of LED light elements. The circuit 300 in this third embodiment is in a half wave configuration, i.e. currents through the LED strings ($LS_1$, $LS_2$, . . . , $LS_N$) are half wave rectified, except for the LED string ($LS_{N-1}$) which is being full wave rectified.

In this third embodiment, the circuit 300 includes two nodes 302, 304 connected with a power supply (which may be, for example, provided by a driver circuit) providing an input voltage $v_{in}$ and an input current $i_{in}$. Preferably, the input current is a sinusoidal AC current that may or may not be offset by a certain phase angle. For illustration purposes, the nodes 302, 304 coupled with the power supply are each presented in the form of a loop or ring in FIG. 3. The circuit 300 in this third embodiment includes a number of LED strings ($LS_1$, $LS_2$, . . . , $LS_N$) connected in series with a number of diodes ($D_1$, $D_2$, . . . , $D_N$). The LED strings ($LS_1$, $LS_2$, . . . , $LS_N$) and the diodes ($D_1$, $D_2$, . . . , $D_N$) together form a closed loop or ring. In the present embodiment, the diodes ($D_1$, $D_2$, . . . , $D_N$) are operable to avoid possible reverse current flow due to short-circuit failure in any of the LED string ($LS_1$, $LS_2$, . . . , $LS_N$). Preferably, in the circuit 300, the LED string-diode loop is connected to the nodes 302, 304 through a number of first capacitors and second capacitors ($C_1$, $C_2$, . . . , $C_N$). More particularly, the first capacitors are the ones that connected in parallel between node 302 and the diodes in the LED string-diode loop; and the second capacitors are the ones that are connected in parallel between the other node 304 and the diodes in the LED string-diode loop. In this embodiment, each of the diodes is connected directly with either the first capacitor or second capacitor, but not with both. More specifically, one diode is connected directly with one of the first capacitors and the next (immediate adjacent) diode is connected directly with one of the second capacitors, thus forming an alternating connection pattern, except for capacitors $C_{N-1}$, $C_N$ which are both second capacitors on the same side. This presence of this exception in the circuit 300 of this embodiment is due to the fact that there are an odd number of capacitors in the circuit 300 (there are an odd number of first capacitors and an even number of second capacitors). As would be appreciated, the sum of the currents ($i_1$, . . . , $i_N$) through all the first and second capacitors ($C_1$, $C_2$, . . . , $C_N$) is equal to the input current $i_{in}$. In the present embodiment, the first and second capacitors ($C_1$, $C_2$ . . . , $C_N$) are operable to provide galvanic isolation between the power input (or driver circuit) and the LED strings ($LS_1$, $LS_2$, . . . , $LS_N$).

In this third embodiment, in order to maintain the current flowing through the LED string-diode loop at all times during operation, each LED elements in the LED strings ($LS_1$, $LS_2$, . . . , $LS_N$) may be provided with different current paths for normal and failure condition. Although not specifically shown in FIG. 3, a bypass element such as a thyristor is preferably connected across each LED elements in the LED string ($LS_1$, $LS_2$, . . . , $LS_N$) such that when an LED element in the LED string-diode loop fails, a bypass path is provided to bypass that failed LED element and the rest of the normal LED elements can continue to operate. In an alternative embodiment, not all of the LED elements in the LED strings are provided with a bypass element for bypass. A current ripple reduction means (not shown) may also be provided for each LED string in circuit 300. In one example, the current ripple reduction means is a pi-filter 1500 (e.g. CLC filter) as illustrated in FIG. 15.

At steady state, the average current of each capacitor ($C_1$, $C_2$, . . . , $C_N$) in the circuit 300 in this third embodiment is zero. Thus, all LED strings ($LS_1$, $LS_2$, . . . , $LS_N$) have substantially the same DC current, irrespective of the LED string voltages ($v_{LS,1}$, $v_{LS,2}$, . . . , $v_{LS,N}$) and the capacitances of the capacitors ($C_1$, $C_2$, . . . , $C_N$). As illustrated in FIG. 3, the circuit 300 includes two main current paths during operation. The first path is the DC current path provided through the LED strings, and the second path is the AC current path passing between the nodes 302, 304 through the first and second capacitors ($C_1$, $C_2$, . . . , $C_N$). The operation of the circuit 300 in FIG. 3 will be described in further detail with reference to FIGS. 7A-7B.

In the third embodiment as illustrated in FIG. 3, one LED string is 'sandwiched' between two adjacent diodes whereas one diode is 'sandwiched' between two adjacent LED strings. However, in other embodiments, any combination or connection of the LED strings and diodes are possible as long as they together define a closed loop. In one example, more than one LED string may be arranged between two diodes.

Figure 4:
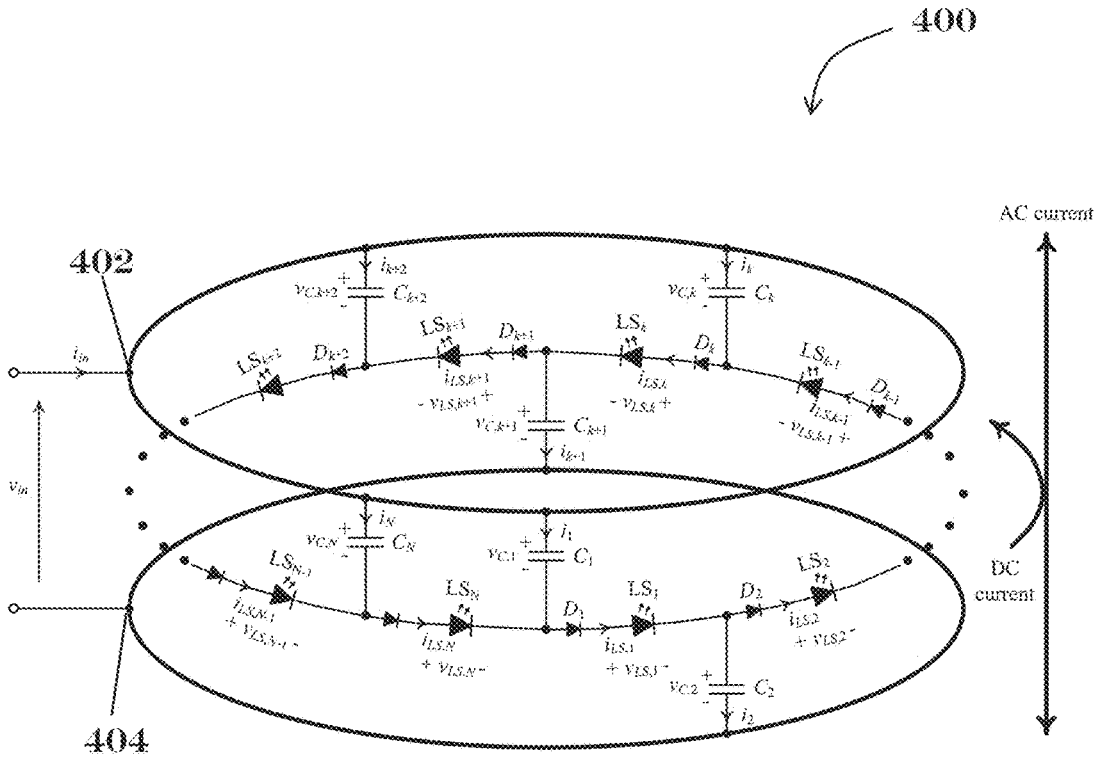
FIG. 4 shows an LED lighting circuit (in half wave configuration, with odd number of LED strings) for balancing currents in LED strings in accordance with a fourth embodiment of the present invention.

FIG. 4 shows an LED lighting circuit 400 for balancing currents in LED strings in accordance with a fourth embodiment of the present invention. In this fourth embodiment, N is an odd number. Also, each LED strings may have one or more LED light elements, and different LED strings may have the same or different number of LED light elements. The circuit 400 in this fourth embodiment is in a half wave configuration, i.e. currents through the LED strings ($LS_1$, $LS_2$, . . . , $LS_N$) are half wave rectified, except for the LED string ($LS_N$) which is being full wave rectified.

The construction of the circuit 400 in this fourth embodiment is substantially the same as the circuit 300 of the third embodiment as shown in FIG. 3, and so the detailed description of the circuit 400 will not be repeatedly provided below. The only difference between the embodiment of the circuit 300 in FIG. 3 and the embodiment of the circuit 400 in FIG.

4 is that in the fourth embodiment of FIG. 4 there are an even number of first capacitors and an odd number of second capacitors in the circuit 400, which is opposite to that of the third embodiment of FIG. 3. As a result of this, the alternating connection pattern of the first and second capacitors is disrupted by capacitors ($C_1$, $C_N$), which are both first capacitors on the same side.

The operation of the circuit 400 in FIG. 4 will be described in further detail with reference to FIGS. 8A-8B.

A. Full Wave Configuration (N Can be Even or Odd)

Figure 5A:
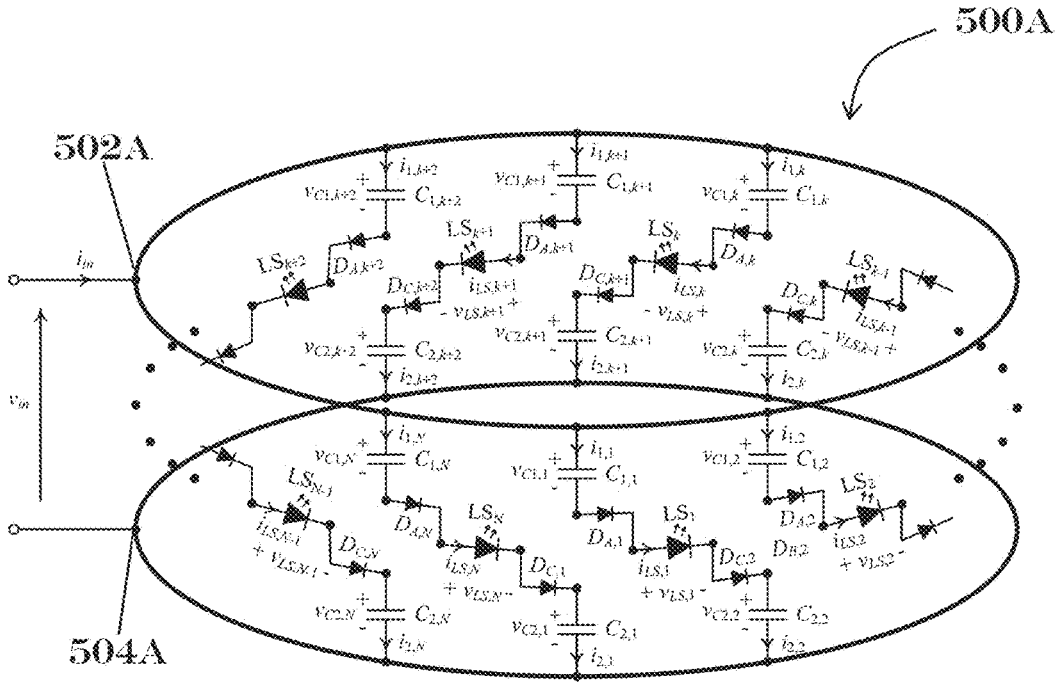
FIG. 5A shows an equivalent circuit for the LED lighting circuit of FIG. 1 during the positive half cycle of input current $i_{in}$.
Figure 5B:
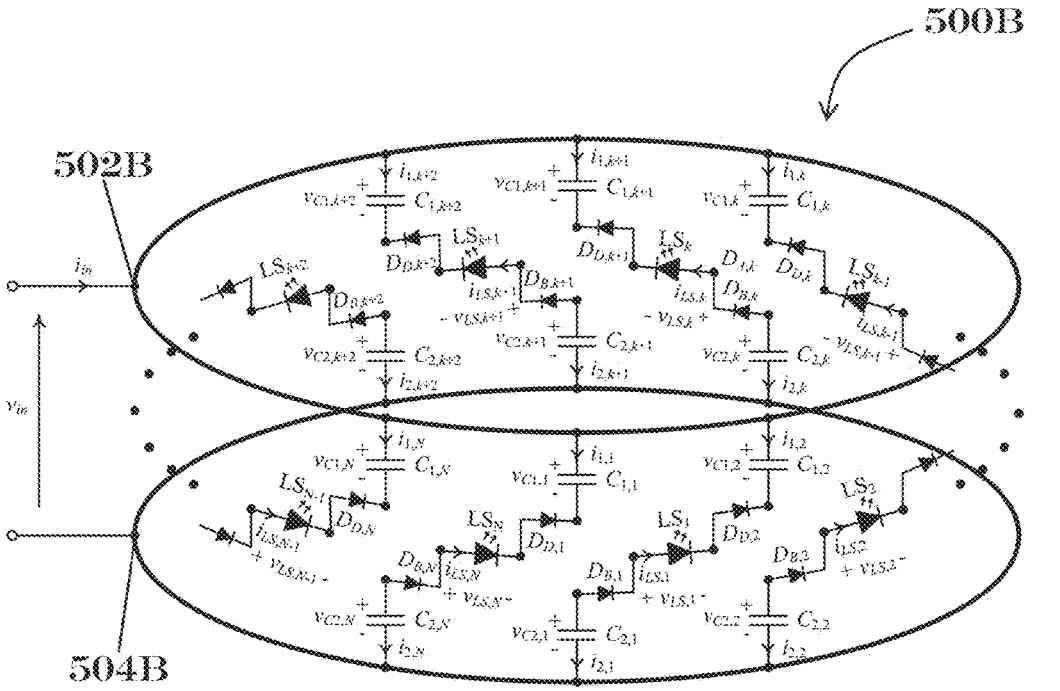
FIG. 5B shows an equivalent circuit for the LED lighting circuit of FIG. 1 during the negative half cycle of input current $i_{in}$.

FIGS. 5A-5B show the circuit topology 500A, 500B of the LED lighting circuit 100 of FIG. 1 during the positive and negative half cycles of input current In this embodiment, the amount of charges that flow through the diodes ($D_{A,k}$, $D_{B,k}$, $D_{C,k}$, $D_{D,k}$; k=1, 2, . . . , N), capacitors $C_{1,k}$ and $C_{2,k}$=1, 2, . . . , N), and LED strings ($LS_1$, $LS_2$, . . . , $LS_N$) in the positive half cycle and negative half cycle are the same.

As shown in FIG. 5A, during the positive half cycle of the input current $i_{in}$, a number of first flow paths are formed in the circuit 500A. In this embodiment, the first flow paths are formed by current passing through the upper (first) node 502A, the first capacitors $C_{1,k}$ (k=1, 2, . . . , N), one of the diodes ($D_{A,1}$, . . . , $D_{A,N}$) in the diode bridge coupled with the first capacitors, the LED strings ($LS_1$, $LS_2$, . . . , $LS_N$), one of the diodes ($D_{C,1}$, . . . , $D_{C,N}$) in another (adjacent) diode bridge, the second capacitors $C_{2,k}$ (k=1, 2, . . . , N) associated with that another (adjacent) diode bridge, then to the lower (second) node 504A. To illustrate the first flow path more clearly, one exemplary first flow path is formed by current $i_{1,1}$ passing from the upper node 502A to the lower node 504A through the first capacitor $C_{1,1}$, the diode $D_{A,1}$, the LED string $LS_1$, the diode $D_{C,1}$, the second capacitor $C_{2,2}$. Preferably, the first and second capacitors are being charged and/or discharged as the current flows in the first flow paths and in a preferred embodiment each of the capacitors charge and discharge through different LED strings. The resulting effect in this embodiment is that all LED strings are lit during the positive half cycle of the input current $i_{in}$.

FIG. 5B shows a number of second flow paths formed in the circuit 500B during the negative half cycle of the input current $i_{in}$. In this embodiment, the second flow paths are formed by current passing through the lower (second) node 504B, the second capacitors $C_{2,k}$ (k=1, 2, . . . , N), one of the diodes ($D_{B,1}$, $D_{B,N}$) in the diode bridge coupled with the second capacitors, the LED strings ($LS_1$, $LS_2$, . . . , $LS_N$), one of the diodes ($D_{D,1}$, . . . , $D_{D,N}$) in another (adjacent) diode bridge, the first capacitors $C_{1,k}$ (k=1, 2, . . . , N) associated with that another (adjacent) diode bridge, then to the upper (first) node 502B. To illustrate the second flow path more clearly, one exemplary second flow path is formed by current $i_{2,1}$ passing from the lower node 504B to the upper node 502B through the second capacitor $C_{2,1}$, the diode $D_{B,1}$, the LED string $LS_1$, the diode $D_{D,2}$, the second capacitor $C_{1,2}$. It should be noted that the currents $i_{in}$, $i_{1,k}$ $i_{2,k}$ are negative in this embodiment and so the direction of the arrows in FIG. 5B is referring to the direction of the negative current. The flow of the currents $i_{in}$, $i_{1,k}$ $i_{2,k}$ in operation should be understood as in a direction reversed to that of the arrows. Preferably, the first and second capacitors are being charged and/or discharged as the current flows in the second flow paths, and in a preferred embodiment each of the capacitors charge and discharge through different LED strings. The resulting effect in this embodiment is that all LED strings are lit during the negative half cycle of the input current $i_{in}$.

In this first embodiment of the circuits 100, 500A, 500B in FIGS. 1, 5A and 5B, currents passing through each of the LED strings during positive and negative cycles of the input current are substantially balanced. This is especially true for steady state conditions. Preferably, the currents are all of the same value in the different LED strings, as the current balancing effect is provided by and shared across each and every LED strings in the LED string-diode bridge loop of the circuit.

Figure 9A:
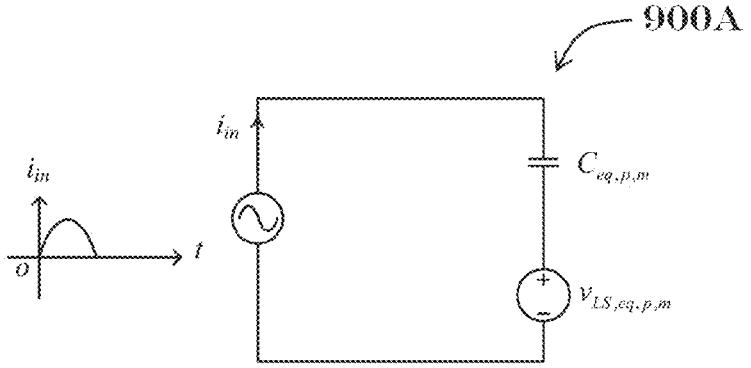
FIG. 9A shows a Thevenin's equivalent circuit model for the LED lighting circuits of FIGS. 1-4 during the positive half cycle of input current $i_{in}$.
Figure 9B:
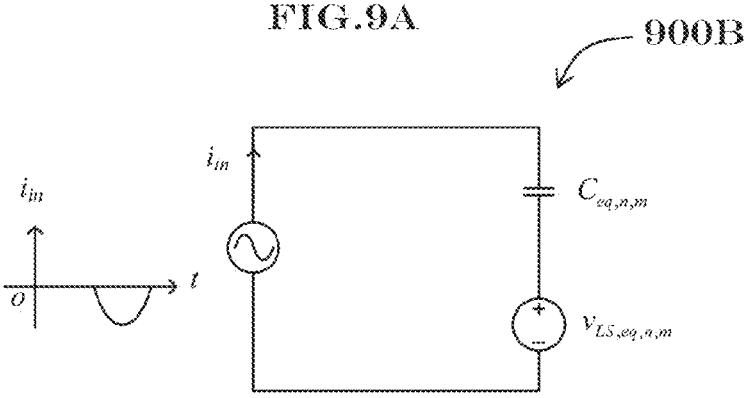
FIG. 9B shows a Thevenin's equivalent circuit model for the LED lighting circuits of FIGS. 1-4 during the negative half cycle of input current $i_{in}$.
Figure 9C:
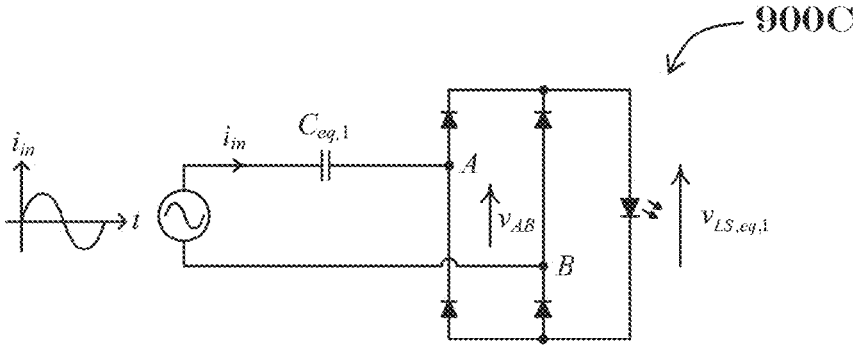
FIG. 9C shows a Thevenin's equivalent circuit model for the LED lighting circuit of FIG. 1.

FIGS. 9A-9C show the Thevenin's equivalent circuit models for the LED lighting circuit of FIGS. 1 (and 5A-5B). Specifically, FIG. 9A shows a Thevenin's equivalent circuit model 900A for the LED lighting circuit 100 of FIG. 1 during the positive half cycle of input current $i_{in}$; FIG. 9B shows a Thevenin's equivalent circuit model 900B for the LED lighting circuit 100 of FIG. 1 during the negative half cycle of input current $i_{in}$; and FIG. 9C shows an overall Thevenin's equivalent circuit model 900C for the LED lighting circuit 100 of FIG. 1.

In this embodiment, the reference m in FIG. 9A is equal to 1, and during the positive half cycle of input current $i_{in}$, the equivalent capacitance of the capacitor $C_{eq,p,1}$ and the equivalent voltage of the voltage source $v_{LS,eq,p,1}$ in the Thevenin's equivalent circuit 900A (for the circuit 100 of FIG. 1) can be expressed as $$C_{eq,p,1} = \sum_{k=1}^{N} C_{eq,p,k,1} \tag{1}$$

$$v_{LS,eq,p,1} = \frac{1}{C_{eq,p,1}} \sum_{k=1}^{N} C_{eq,p,k,1} v_{LS,k} \tag{2}$$

where $$C_{eq,p,k,1} = \frac{C_{1,k} C_{2,k+1}}{C_{1,k} + C_{2,k+1}},\ C_{eq,p,N,1} = \frac{C_{1,N} C_{2,1}}{C_{1,N} + C_{2,1}},$$

$$\text{and } k = 1, 2, \ldots, N-1.$$

Similarly, in this embodiment, the reference m in FIG. 9B is equal to 1, and during the negative half cycle of input current $i_{in}$, the equivalent capacitance of the capacitor $C_{eq,n,1}$ and the equivalent voltage of the voltage source $v_{LS,eq,n,1}$ in the Thevenin's equivalent circuit 900B (for the circuit 100 of FIG. 1) can be expressed as $$C_{eq,n,1} = \sum_{k=1}^{N} C_{eq,n,k,1} \tag{3}$$

$$v_{LS,eq,n,1} = \frac{1}{C_{eq,n,1}} \left( C_{eq,n,1,1} v_{LS,N} + \sum_{k=2}^{N} C_{eq,n,k,1} v_{LS,k-1} \right) \tag{4}$$

where $$C_{eq,n,1,1} = \frac{C_{1,1} C_{2,N}}{C_{1,1} + C_{2,N}},\ C_{eq,n,k,1} = \frac{C_{1,k} C_{2,k-1}}{C_{1,k} + C_{1,k-1}}, \text{ and } k = 2, 3, \ldots, N.$$

With $$C_{1,k} = C_{2,k} = C \tag{5},$$

it can be shown that $$C_{eq,p,1} = C_{eq,n,1} = \frac{N}{2}C \tag{6}$$

$$v_{LS,eq,p,1} = v_{LS,eq,n,1} = \frac{1}{N}\sum_{k=1}^{N} v_{LS,k} \tag{7}$$

By using the averaging technique, an equivalent model 900C shown in FIG. 9C is derived for the circuit 100 of FIG. 1. In the circuit model 900C of FIG. 9C, reference m is equal to 1, and the equivalent voltage of the voltage source $v_{LS,eq,1}$ and the equivalent capacitance of the capacitor $C_{eq,1}$ (for the circuit 100 of FIG. 1) can be expressed as $$C_{eq,1} = 0.5C_{eq,p,1} + 0.5C_{eq,n,1} = \frac{N}{2}C \tag{8}$$

$$v_{LS,eq,1} = 0.5v_{LS,eq,p,1} + 0.5v_{LS,eq,n,1} = \frac{1}{N}\sum_{k=1}^{N} v_{LS,k} \tag{9}$$

B. Half Wave Configuration (N is Even)

Figure 6A:
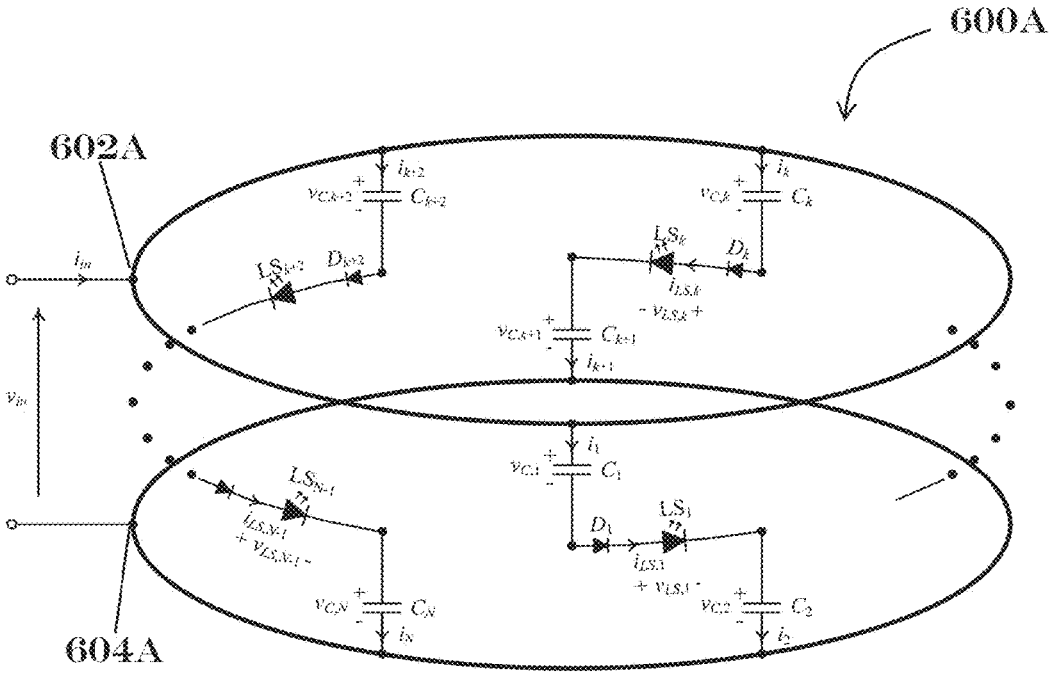
FIG. 6A shows an equivalent circuit for the LED lighting circuit of FIG. 2 during the positive half cycle of input current $i_{in}$.
Figure 6B:
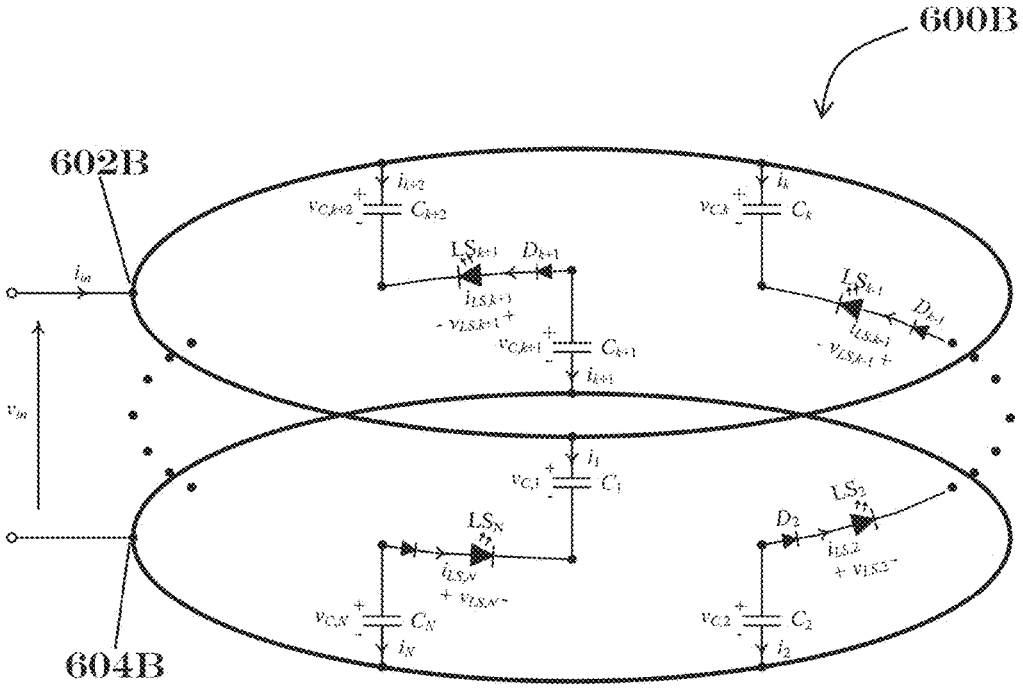
FIG. 6B shows an equivalent circuit for the LED lighting circuit of FIG. 2 during the negative half cycle of input current $i_{in}$.

FIGS. 6A-6B show the circuit topology 600A, 600B of the LED lighting circuit 200 of FIG. 2 during the positive and negative half cycles of input current $i_{in}$.

As shown in FIG. 6A, during the positive half cycle of the input current $i_{in}$, a number of first flow paths are formed in the circuit 600A. In this embodiment, the first flow paths are formed by current passing through the upper (first) node 602A, the first capacitors $C_k$ (k=odd number), diodes $D_k$ (k=odd number) coupled directly with the first capacitors, the LED strings $LS_k$ (k=odd number), the second capacitors $C_{k+1}$ (k=odd number), then to the lower (second) node 604A. To illustrate the first flow path in the circuit 600A of this second embodiment more clearly, one exemplary first flow path is formed by current $i_1$ passing from the upper node 602A to the lower node 604A through the first capacitor $C_1$, the diode $D_1$, the LED string $LS_1$, and the second capacitor $C_2$. Preferably, the first and capacitors are being charged and or discharged as the current flows in the first flow paths. The resulting effect in this embodiment is that the odd numbered LED strings are lit during the positive half cycle of the input current $i_{in}$.

FIG. 6B shows a number of second flow paths formed in the circuit 600B during the negative half cycle of the input current $in_{in}$. In this embodiment, the second flow paths are formed by current passing through the lower (second) node 604B, the second capacitors $C_{k+1}$ (k=odd number), diodes $D_{k+1}$ (k=odd number) coupled directly with the second capacitors, the LED strings $LS_{k+1}$ (k=odd number), the first capacitors $C_{k+2}$ (k=odd number), then to the upper (first) node 602B. To illustrate the second flow path more clearly, one exemplary second flow path is formed by current $i_{k+1}$ passing from the lower node 604B to the upper node 602B through the second capacitor $C_{k+1}$, the diode $D_{k+1}$, the LED string $LS_{k+1}$, and the second capacitor $C_{k+2}$. It should be noted that the currents $i_{in}$, $i_k$ are negative in this embodiment and so the direction of the arrows in FIG. 6B is referring to the direction of the negative current. The flow of the currents $i_{in}$, $i_k$ in operation should be understood as in a direction reversed to that of the arrows. Preferably, the first and second capacitors are being charged and or discharged as the current flows in the second flow paths, and in a preferred embodiment the capacitors charge and discharge through different LED strings. The resulting effect in this embodiment is that even numbered LED strings are lit during the negative half cycle of the input current $i_{in}$.

As the number of LED strings in this embodiment is an even number, one half of the LED strings will be lit in the positive cycle and the other half will be lit in the negative cycle. In one embodiment, the net effect provided by the current balancing effect is that the resultant luminous flux in the circuit 200 remains substantially constant during operation and the change in flux may even be not noticeable, given that the frequency of the positive and negative cycle input power (e.g. current $i_{in}$) waves are sufficiently high.

Figure 9D:
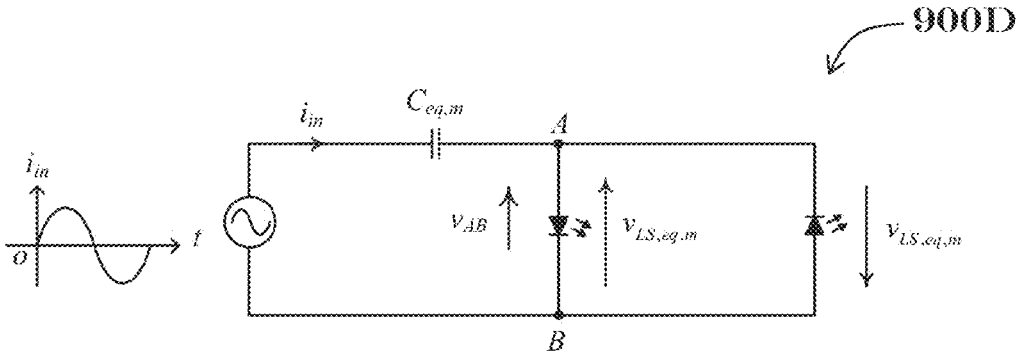
FIG. 9D shows a Thevenin's equivalent circuit model for the LED lighting circuits of FIGS. 2-4.

FIGS. 9A, 9B and 9D show a Thevenin's equivalent circuit models for the LED lighting circuit 200 of FIGS. 2 (and 6A-6B). Specifically, FIG. 9A shows a Thevenin's equivalent circuit model 900A for the LED lighting circuit 200 of FIG. 2 during the positive half cycle of input current $i_{in}$; FIG. 9B shows a Thevenin's equivalent circuit model 900B for the LED lighting circuit 200 of FIG. 2 during the negative half cycle of input current $i_{in}$; and FIG. 9D shows an overall Thevenin's equivalent circuit model 900D for the LED lighting circuit 200 of FIG. 2.

In this embodiment, the reference m in FIG. 9A is equal to 2, and during the positive half cycle of input current $i_{in}$, the equivalent voltage of the capacitor $C_{eq,p,2}$ and the equivalent voltage of the voltage source $v_{LS,eq,p,2}$ in the Thevenin's equivalent circuit 900A (for the circuit 200 of FIG. 2) can be expressed as $$C_{eq,p,2} = \sum_{k=1}^{N/2} C_{eq,p,2k-1,2} \tag{10}$$

$$v_{LS,eq,p,2} = \frac{1}{C_{eq,p,2}}\sum_{k=1}^{N/2} C_{eq,p,2k-1,2}v_{LS,2k-1} \tag{11}$$

where $$C_{eq,p,2k-1,2} = \frac{C_{2k-1}C_{2k}}{C_{2k-1}+C_{2k}}.$$

Similarly, in this embodiment, the reference m in FIG. 9B is equal to 2, and during the negative half cycle of input current the equivalent voltage of the capacitor $C_{eq,n,2}$ and the equivalent voltage of the voltage source $v_{LS,eq,n,2}$ in the Thevenin's equivalent circuit 900B (for the circuit 200 of FIG. 2) can be expressed as $$C_{eq,n,2} = \sum_{k=1}^{N/2} C_{eq,n,2k,2} \tag{12}$$

$$v_{LS,eq,n,2} = \frac{1}{C_{eq,n,2}}\sum_{k=1}^{N/2} C_{eq,n,2k,2}v_{LS,2k} \tag{13}$$

where $$C_{eq,n,2k,2} = \frac{C_{2k}C_{2k+1}}{C_{2k}+C_{2k+1}},\ C_{eq,n,N,2} = \frac{C_1C_N}{C_1+C_N},\ \text{and}\ k = 1, 2, \ldots, \frac{N-2}{2}.$$

With $$C_k = C \tag{14}$$

it can be shown that $$C_{eq,p,2} = C_{eq,n,2} = \frac{N}{4}C \tag{15}$$

$$v_{LS,eq,p,2} = \frac{2}{N}\sum_{k=1}^{N/2} v_{LS,2k-1} \tag{16}$$

$$v_{LS,eq,n,2} = \frac{2}{N}\sum_{k=1}^{N/2} v_{LS,2k} \tag{17}$$

By using the averaging technique, an equivalent model 900D shown in FIG. 9D is derived for the circuit 200 of FIG. 2. In the circuit model 900D of FIG. 9D, reference m is equal to 2, and the equivalent capacitance of the capacitor $C_{eq,2}$ and the equivalent voltage of the voltage source $v_{LS,eq,2}$ (for the circuit 200 of FIG. 2) can be expressed as $$C_{eq,2} = 0.5C_{eq,p,2} + 0.5C_{eq,n,2} = \frac{N}{4}C \tag{18}$$

$$v_{LS,eq,2} = 0.5v_{LS,eq,p,2} + 0.5v_{LS,eq,n,2} = \frac{1}{N}\sum_{k=1}^{N} v_{LS,k} \tag{19}$$

C. Half Wave Configuration (N is Odd)

Figure 7A:
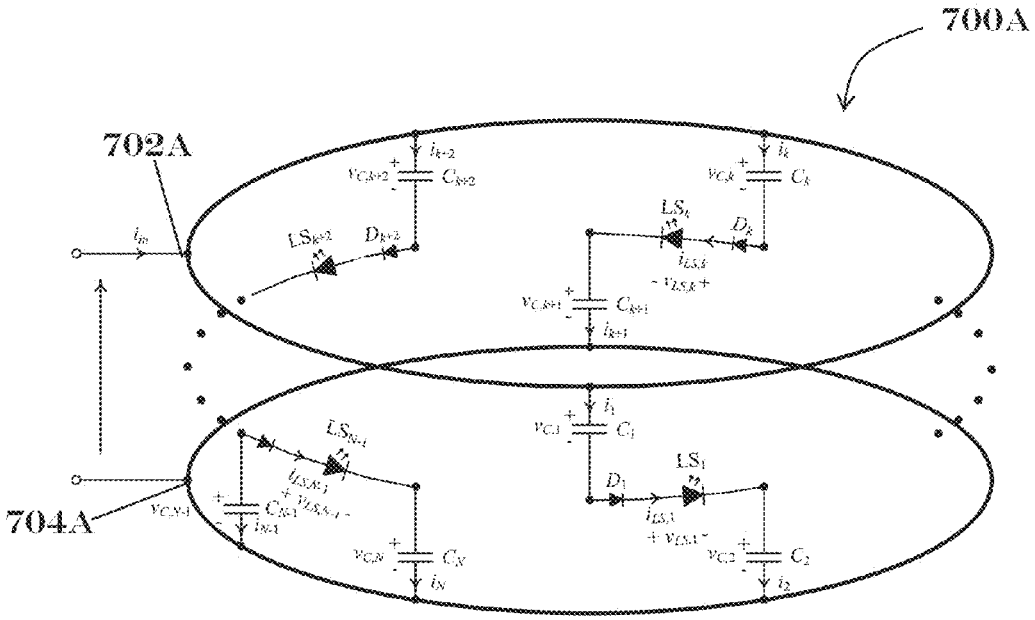
FIG. 7A shows an equivalent circuit for the LED lighting circuit of FIG. 3 during the positive half cycle of input current $i_{in}$.
Figure 7B:
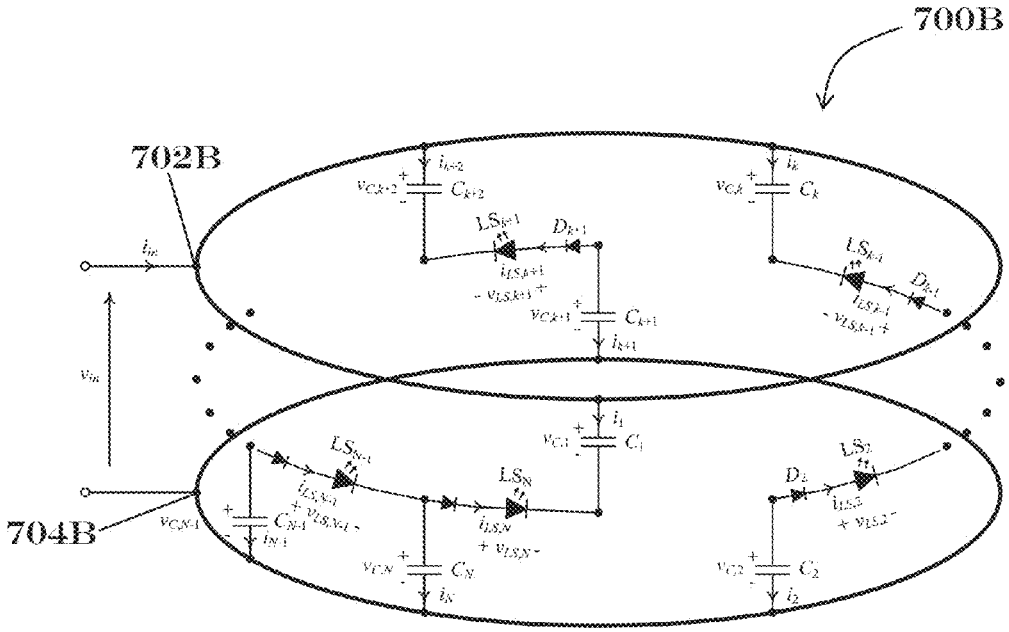
FIG. 7B shows an equivalent circuit for the LED lighting circuit of FIG. 3 during the negative half cycle of input current $i_{in}$.

FIGS. 7A-7B show the circuit topology 700A, 700B of the LED lighting circuit 300 of FIG. 3 during the positive and negative half cycles of input current $i_{in}$. In this embodiment, the total number of first and second capacitors in the circuit 300 is an odd number (an odd number of first capacitors and an even number of second capacitors).

As shown in FIG. 7A, during the positive half cycle of the input current a number of first flow paths are formed in the circuit 700A. In this third embodiment, the first flow paths are formed by current passing through the upper (first) node 702A, the first capacitors $C_k$ (k=odd number), diodes $D_k$ (k=odd number) coupled directly with the first capacitors, the LED strings $LS_k$ (k=odd number), the second capacitors $C_{k+1}$ (k=odd number), then to the lower (second) node 704A. To illustrate the first flow path in this third embodiment more clearly, one exemplary first flow path is formed by current $i_1$ passing from the upper node 702A to the lower node 704A through the first capacitor $C_1$, the diode $D_1$, the LED string $LS_1$, and the second capacitor $C_2$. Preferably, the first and capacitors are being charged and or discharged as the current flows in the first flow paths.

In this third embodiment, as a result of the total number of first and second capacitors being an odd number in the circuit 300, a third flow path is present from the upper node 702A to the lower node 704A during the positive cycle of the input current $i_{in}$. Specifically, the third flow path is formed by current passing from the upper node 702A to the lower node 704A through the first capacitor $C_{N-2}$ (not shown), the diode $D_{N-2}$ (not shown), the LED string $LS_{N-2}$ (not shown), the diode $D_{N-1}$, the LED string $LS_{N-1}$ and the second capacitor $C_N$. Preferably, the effect on the current distribution in the LED strings due to this additional third flow path is absorbed throughout the LED string-diode loop or ring and thus the current through the LED strings remain substantially balanced during operation.

FIG. 7B shows a number of second flow paths formed in the circuit 700B during the negative half cycle of the input current $i_{in}$. In this third embodiment, the second flow paths are formed by current passing through the lower (second) node 704B, the second capacitors $C_{k+1}$ (k=odd number), diodes $D_{k+1}$ (k=odd number) coupled directly with the second capacitors, the LED strings $LS_{k+1}$ (k=odd number), the first capacitors $C_{k+2}$ (k=odd number), then to the upper (first) node 702B. To illustrate the second flow path more clearly, one exemplary second flow path is formed by current $i_{k+1}$ passing from the lower node 704B to the upper node 702B through the second capacitor $C_{k+1}$, the diode $D_{k+1}$, the LED string $LS_{k+1}$, and the second capacitor $C_{k+2}$. It should be noted that the currents $i_{in}$, $i_k$ are negative in this embodiment and so the direction of the arrows in the circuit 700B of FIG. 7B is referring to the direction of the negative current. The flow of the currents $i_{in}$, $i_k$ in operation should be understood as in a direction reversed to that of the arrows. Preferably, the first and second capacitors are being charged and or discharged as the current flows in the second flow paths, and in a preferred embodiment the capacitors charge and discharge through different LED strings. In one example, each capacitor is charged through one string and discharged through another.

In this third embodiment, as a result of the total number of first and second capacitors being an odd number in the circuit 300, a fourth flow path is present from the lower node 704B to the upper node 702B during the negative cycle of the input current $i_{in}$. Specifically, the fourth flow path is formed by current passing from the lower node 704B to the upper node 702B through the second capacitor $C_{N-1}$, the diode $D_{N-1}$, the LED string $LS_{N-1}$, the diode $D_N$, the LED string $LS_N$ and the first capacitor $C_1$. Preferably, the effect on the current distribution in the LED strings due to this additional fourth flow path is absorbed throughout the LED string-diode loop or ring and thus the current through the LED strings remain substantially balanced during operation.

In the present embodiment, the current flowing through all the LED strings are half-wave rectified except LED string $LS_{N-1}$ which is full wave rectified. In addition, as the number of LED strings in this embodiment is an odd number, one group of the LED strings will be lit in the positive cycle and the other group will be lit in the negative cycle. In this particularly embodiment, one of the LED strings (i.e. LED string $LS_{N-1}$) belongs to both group and is thus lit at both the positive and negative cycles. By properly regulating the current in the circuit 300, the net effect of the resultant luminous flux of the overall circuit 300 will not vary substantially during operation and the change in flux may even be not noticeable, given that the frequency of the positive and negative cycle input power (e.g. current $i_{in}$) waves are sufficiently high.

FIGS. 9A, 9B and 9D show a Thevenin's equivalent circuit models for the LED lighting circuit 300 of FIGS. 3 (and 7A-7B). Specifically, FIG. 9A shows a Thevenin's equivalent circuit model 900A for the LED lighting circuit 300 of FIG. 3 during the positive half cycle of input current $i_{in}$; FIG. 9B shows a Thevenin's equivalent circuit model 900B for the LED lighting circuit 300 of FIG. 3 during the negative half cycle of input current and FIG. 9D shows an overall Thevenin's equivalent circuit model 900D for the LED lighting circuit 300 of FIG. 3.

In this third embodiment, the currents flowing through all the LED strings are half-wave rectified except for LED string $LS_{N-1}$. The reference m in FIG. 9A is equal to 3 in this embodiment, and during the positive half cycle of input current the equivalent capacitance of the capacitor $C_{eq,p,3}$ and voltage of the voltage source $v_{LS,eq,p,3}$ in the Thevenin's equivalent circuit 900A (for the circuit 300 of FIG. 3) can be expressed as $$C_{eq,p,3} = \sum_{k=1}^{(N-3)/2} C_{eq,p,2k-1,3} + C_{eq,p,N-2,3} \tag{20}$$

$$v_{LS,eq,p,3} = \frac{1}{C_{eq,p,3}}\left[\sum_{k=1}^{(N-3)/2} C_{eq,p,2k-1,3} v_{LS,2k-1} + C_{eq,p,N-2,3}\left(v_{LS,N-2} + \frac{C_N}{C_{N-1}+C_N} v_{LS,N-1}\right)\right] \tag{21}$$

where $$C_{eq,p,2k-1,3} = \frac{C_{2k-1}C_{2k}}{C_{2k-1}+C_{2k}},$$

$$C_{eq,p,N-2,3} = \frac{C_{N-2}(C_{N-1}+C_N)}{C_{N-2}+C_{N-1}+C_N}, \text{ and } k = 1, 2, \ldots, \frac{N-3}{2}.$$

Similarly, in this embodiment, the reference m in FIG. 9B is equal to 3, and during the negative half cycle of input current $i_{in}$, the equivalent capacitance of the capacitor $C_{eq,n,3}$ and the equivalent voltage of the voltage source $v_{LS,eq,n,3}$ in the Thevenin's equivalent circuit 900B (for the circuit 300 of FIG. 3) can be expressed as $$C_{eq,n,3} = \sum_{k=1}^{(N-3)/2} C_{eq,n,2k,3} + C_{eq,n,N-1,3} \tag{22}$$

$$v_{LS,eq,n,3} = \frac{1}{C_{eq,n,3}}\left[\sum_{k=1}^{(N-3)/2} C_{eq,n,2k,3} v_{LS,2k} + C_{eq,n,N-1,3}\left(\frac{C_{N-1}}{C_{N-1}+C_N} v_{LS,N-1} + v_{LS,N}\right)\right] \tag{23}$$

where $$C_{eq,n,2k,3} = \frac{C_{2k}C_{2k+1}}{C_{2k}+C_{2k+1}},$$

when $$k = 1, 2, \ldots, \frac{N-3}{2} \text{ and } C_{eq,n,N-1,3} = \frac{C_1(C_{N-1}+C_N)}{C_1+C_{N-1}+C_n}.$$

With $$C_k = C,$$

$$C_{eq,p,3} = C_{eq,n,3} = \frac{3N-1}{12}C \tag{24}$$

$$v_{LS,eq,p,3} = \frac{2}{3N-1}\left[3\sum_{k=1}^{(N-3)/2} v_{LS,2k-1} + 2(2v_{LS,N-2} + v_{LS,N-1})\right] \tag{25}$$

-continued $$v_{LS,eq,n,3} = \frac{2}{3N-1}\left[3\sum_{k=1}^{(N-3)/2} v_{LS,2k} + 2(v_{LS,N-1} + 2v_{LS,N})\right] \tag{26}$$

By using the averaging technique, an equivalent model 900D shown in FIG. 9D is derived for the circuit 300 of FIG. 3. In FIG. 9D of this embodiment, reference m is equal to 3, and the equivalent capacitance of the capacitor $C_{eq,3}$ and the equivalent voltage of the voltage source $v_{LS,eq,3}$ (for the circuit 300 of FIG. 3) can be expressed as $$C_{eq,3} = 0.5C_{eq,p,3} + 0.5C_{eq,n,3} = \frac{3N-1}{12}C \tag{27}$$

$$v_{LS,eq,3} = 0.5v_{LS,eq,p,3} + 0.5v_{LS,eq,n,3} = \frac{1}{3N-1}\left(3\sum_{k=1}^{N-3} v_{LS,k} + 4\sum_{k=N-2}^{N} v_{LS,k}\right) \tag{28}$$

D. Half Wave Configuration (N is Odd)

Figure 8A:
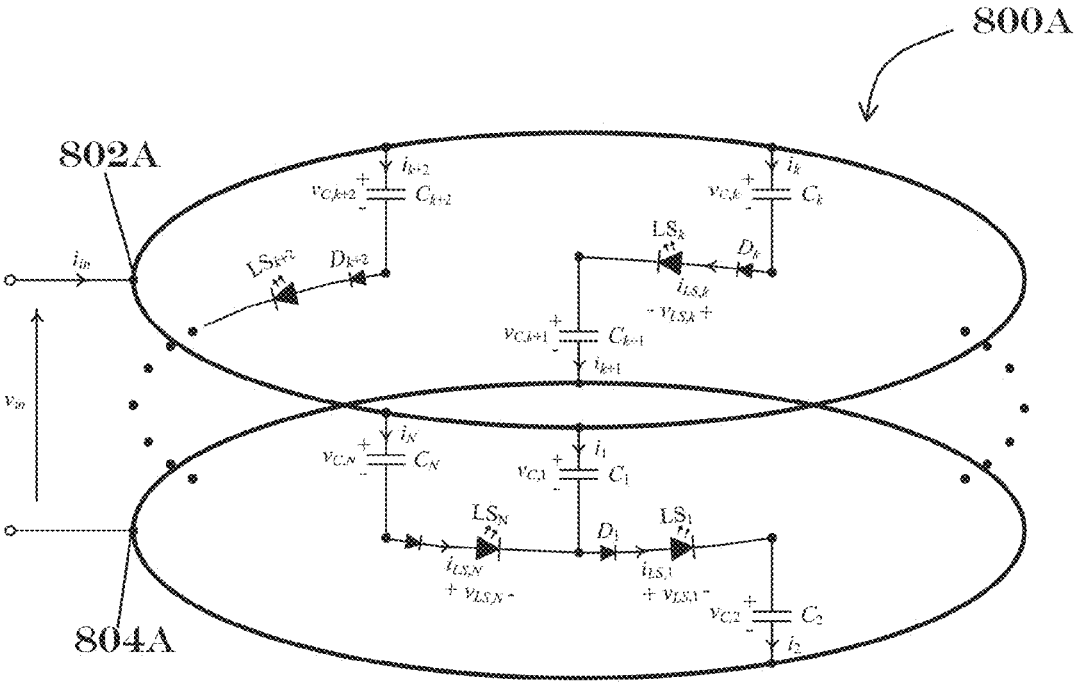
FIG. 8A shows an equivalent circuit for the LED lighting circuit of FIG. 4 during the positive half cycle of input current $i_{in}$.
Figure 8B:
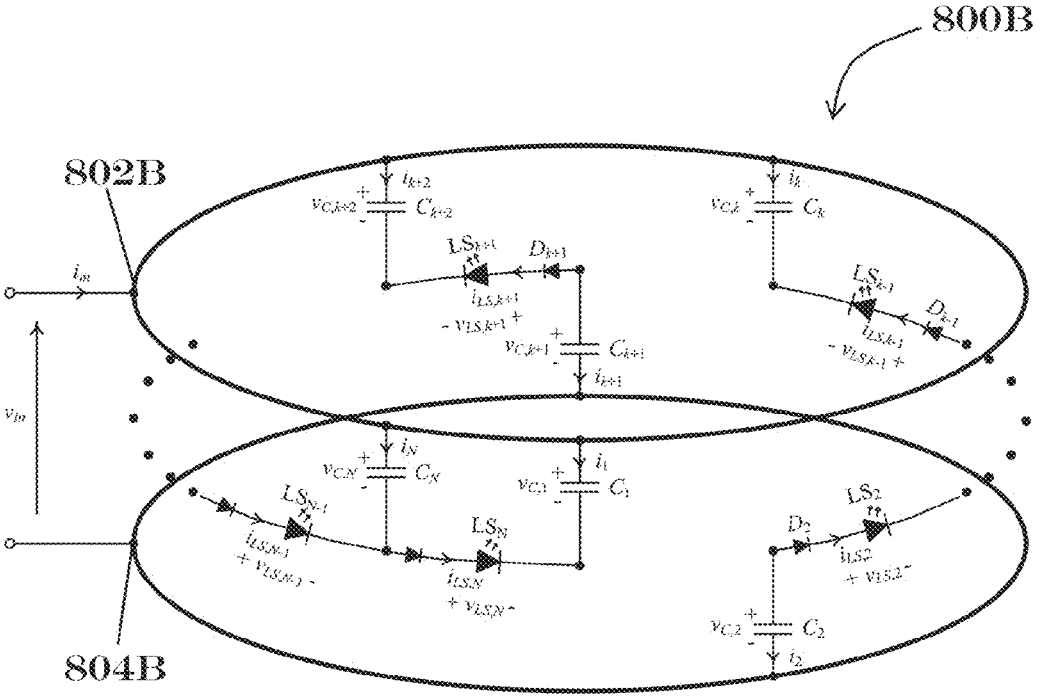
FIG. 8B shows an equivalent circuit for the LED lighting circuit of FIG. 4 during the negative half cycle of input current $i_{in}$.

FIGS. 8A-8B show the circuit topology 800A, 800B of the LED lighting circuit 400 of FIG. 4 during the positive and negative half cycles of input current $i_{in}$. In this embodiment, the total number of first and second capacitors in the circuit 400 is an odd number (an even number of first capacitors and an odd number of second capacitors).

As shown in FIG. 8A, during the positive half cycle of the input current $i_{in}$, a number of first flow paths are formed in the circuit 800A. In this embodiment, the first flow paths are formed by current passing through the upper (first) node 802A, the first capacitors $C_k$ (k=odd number), diodes $D_k$ (k=odd number) coupled directly with the first capacitors, the LED strings $LS_k$ (k=odd number), the second capacitors $C_{k+1}$ (k=odd number), then to the lower (second) node 804A. To illustrate the first flow path in this fourth embodiment more clearly, one exemplary first flow path is formed by current $i_1$ passing from the upper node 802A to the lower node 804A through the first capacitor $C_1$, the diode $D_1$, the LED string $LS_1$, and the second capacitor $C_2$. Preferably, the first and capacitors are being charged and or discharged as the current flows in the first flow paths.

In this fourth embodiment, as a result of the total number of first and second capacitors being an odd number in the circuit 400, a third flow path is present from the upper node 802A to the lower node 804A during the positive cycle of the input current $i_{in}$. Specifically, the third flow path is formed by current passing from the upper node 802A to the lower node 804A through the first capacitor $C_N$, the diode $D_N$, the LED string $LS_N$, the diode $D_1$, the LED string $LS_1$ and the second capacitor $C_2$. Preferably, the effect on the current distribution in the LED strings due to this additional third flow path is absorbed throughout the LED string-diode loop or ring and thus the current through the LED strings remain substantially balanced during operation.

FIG. 8B shows a number of second flow paths formed in the circuit 800B during the negative half cycle of the input current $i_{in}$. In this fourth embodiment, the second flow paths are formed by current passing through the lower (second) node 804B, the second capacitors $C_{k+1}$ (k=odd number), diodes $D_{k+1}$ (k=odd number) coupled directly with the second capacitors, the LED strings $LS_{k+1}$ (k=odd number), the first capacitors $C_{k+2}$ (k=odd number), then to the upper (first) node 802B. To illustrate the second flow path more clearly, one exemplary second flow path is formed by current $i_{k+1}$ passing from the lower node 804B to the upper node 802B through the second capacitor $C_{k+1}$, the diode $D_{k+1}$, the LED string $LS_{k+1}$, and the second capacitor $C_{k+2}$. It should be noted that the currents $i_{in}$, $i_k$ are negative in this embodiment and so the direction of the arrows in the circuit 800B of FIG. 8B is referring to the direction of the negative current. The flow of the currents $i_{in}$, $i_k$ in operation should be understood as in a direction reversed to that of the arrows. Preferably, the first and second capacitors are being charged and or discharged as the current flows in the second flow paths, and in a preferred embodiment the capacitors charge and discharge through different LED strings. In one example, each capacitor is charged through one string and discharged through another.

In this fourth embodiment, as a result of the total number of first and second capacitors being an odd number in the circuit 400, a fourth flow path is present from the lower node 804B to the upper node 802B during the negative cycle of the input current $i_{in}$. Specifically, the fourth flow path is formed by current passing from the lower node 804B to the upper node 802B through the second capacitor $C_{N-1}$ (not shown), the diode $D_{N-1}$, the LED string $LS_{N-1}$, the diode $D_N$, the LED string $LS_N$ and the first capacitor $C_1$. Preferably, the effect on the current distribution in the LED strings due to this additional fourth flow path is absorbed throughout the LED string-diode loop or ring and thus the current through the LED strings remain substantially balanced during operation.

In the present embodiment, the current flowing through all the LED strings are half-wave rectified except LED string $LS_{N-1}$ which is full wave rectified. In addition, as the number of LED strings in this embodiment is an odd number, one group of the LED strings will be lit in the positive cycle and the other group will be lit in the negative cycle. In this particularly embodiment, one of the LED strings (i.e. LED string $LS_{N-1}$) belongs to both group and is thus lit at both the positive and negative cycles. By properly regulating the current in the circuit 400, the net effect of the resultant luminous flux of the overall circuit 400 will not vary substantially during operation and the change in flux may even be not noticeable, given that the frequency of the positive and negative cycle input power (e.g. current $i_{in}$) waves are sufficiently high.

FIGS. 9A, 9B and 9D show a Thevenin's equivalent circuit models for the LED lighting circuit 400 of FIGS. 4 (and 8A-8B). Specifically, FIG. 9A shows a Thevenin's equivalent circuit model 900A for the LED lighting circuit 400 of FIG. 4 during the positive half cycle of input current $i_{in}$; FIG. 9B shows a Thevenin's equivalent circuit model 900B for the LED lighting circuit 400 of FIG. 4 during the negative half cycle of input current $i_{in}$; and FIG. 9D shows an overall Thevenin's equivalent circuit model 900D for the LED lighting circuit 400 of FIG. 4.

In this fourth embodiment, the currents flowing through all the LED strings are half-wave rectified except for LED string $LS_{N-1}$. The reference m in FIG. 9A is equal to 4 in this fourth embodiment, and during the positive half cycle of input current $i_{in}$, the equivalent capacitance of the capacitor $C_{eq,p,4}$ and voltage of the voltage source $v_{LS,eq,p,4}$ in the Thevenin's equivalent circuit 900A (for the circuit 400 of FIG. 4) can be expressed as $$C_{eq,p,4} = \sum_{k=2}^{(N-1)/2} C_{eq,p,2k-1,4} + C_{eq,p,1,4} \tag{29}$$

-continued $$v_{LS,eq,p,4} = \frac{1}{C_{eq,p,4}}\left[\sum_{k=2}^{(N-1)/2} C_{eq,p,2k-1,4} v_{LS,2k-1} + C_{eq,p,1,4}\left(v_{LS,1} + \frac{C_N}{C_1 + C_N} v_{LS,N}\right)\right] \tag{30}$$

where $$C_{eq,p,2k-1,4} = \frac{C_{2k-1}C_{2k}}{C_{2k-1} + C_{2k}},$$

$$C_{eq,p,1,4} = \frac{C_2(C_1 + C_N)}{C_1 + C_2 + C_N}, \text{ and } k = 2, 3, \ldots, \frac{N-1}{2}.$$

Similarly, in this embodiment, the reference m in FIG. 9B is equal to 4, and during the negative half cycle of input current the equivalent capacitance of the capacitor $C_{eq,n,4}$ and the equivalent voltage of the voltage source $v_{LS,eq,n,4}$ in the Thevenin's equivalent circuit 900B (for the circuit 400 of FIG. 4) can be expressed as $$C_{eq,n,4} = \sum_{k=1}^{(N-3)/2} C_{eq,n,2k,4} + C_{eq,n,N-1,4} \tag{31}$$

$$v_{LS,eq,n,4} = \frac{1}{C_{eq,n,4}}\left[\sum_{k=1}^{(N-3)/2} C_{eq,n,2k,4} v_{LS,2k} + C_{eq,n,N-1,4}\left(v_{LS,N-1} + \frac{C_1}{C_1 + C_N} v_{LS,N}\right)\right] \tag{32}$$

where $$C_{eq,n,2k,4} = \frac{C_{2k}C_{2k+1}}{C_{2k} + C_{2k+1}}, \quad C_{eq,n,N-1,4} = \frac{C_{N-1}(C_1 + C_N)}{C_{N-1} + C_1 + C_N},$$

$$\text{and } k = 1, 2, \ldots, \frac{N-3}{2}.$$

With $$C_k = C,$$

$$C_{eq,p,4} = C_{eq,n,4} = \frac{3N-1}{12} C \tag{33}$$

$$v_{LS,eq,p,4} = \frac{2}{3N-1}\left[3\sum_{k=2}^{(N-1)/2} v_{LS,2k-1} + 2(2v_{LS,1} + v_{LS,N})\right] \tag{34}$$

$$v_{LS,eq,n,4} = \frac{2}{3N-1}\left[3\sum_{k=1}^{(N-3)/2} v_{LS,2k} + 2(v_{LS,N-1} + v_{LS,N})\right] \tag{35}$$

By using the averaging technique, an equivalent model 900D shown in FIG. 9D is derived for the circuit 400 of FIG. 4. In FIG. 9D of this embodiment, reference m is equal to 4, and the equivalent capacitance of the capacitor $C_{eq,4}$ and the equivalent voltage of the voltage source $v_{LS,eq,4}$ (for the circuit 400 of FIG. 4) can be expressed as $$C_{eq,A} = 0.5C_{eq,p,A} + 0.5C_{eq,n,A} = \frac{3N-1}{12}C \quad (36)$$

$$v_{LS,eq,A} = 0.5v_{LS,eq,p,A} + 0.5v_{LS,eq,n,A} = \frac{1}{3N-1}\left[3\sum_{k=2}^{N-3} v_{LS,k} + 4\left(v_{LS,1} + \sum_{k=N-1}^{N} v_{LS,k}\right)\right] \quad (37)$$

Driver Circuit

Figure 10:
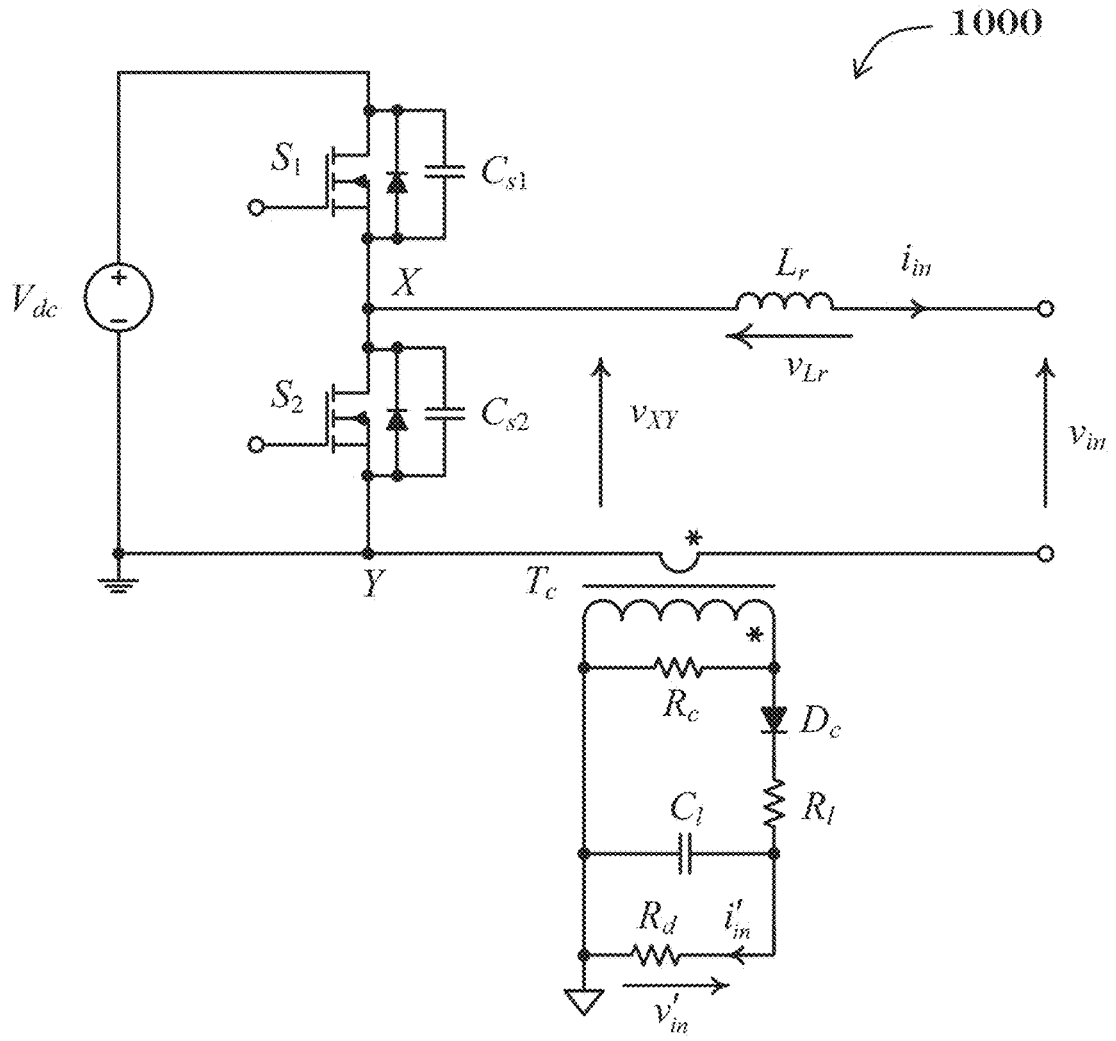
FIG. 10 shows a driver circuit for driving LED lighting circuits (such as the LED lighting circuit embodiments shown in FIGS. 1-4) in accordance with one embodiment of the present invention.

Referring now to FIG. 10, there is provided a driver circuit for driving an LED lighting circuit, wherein the driver circuit is arranged to be connected between a power source and an LED lighting circuit for regulating power transmitted from the power source to the LED lighting circuit, and the driver circuit comprises one or more switching devices adapted to be connected in series with the power source, and an output across one of the one or more switching devices is arranged to act as an input to the LED lighting circuit.

As shown in FIG. 10, the driver circuit 1000 in one embodiment of the present invention includes a half-bridge series resonant converter. Preferably, the driver circuit 1000 is adapted to be connected between a power source $V_{dc}$ and a LED lighting circuit (connected across $V_{in}$, not shown) such as the ones as shown in FIGS. 1-4 for regulating power transmitted from the power source $V_{dc}$ to the LED lighting circuit.

In the present embodiment, the driver circuit 1000 includes two MOSFET switches $S_1$, $S_2$. Each of the MOSFET switches $S_1$, $S_2$ are connected in parallel with a diode and a capacitor $C_{s1}$, $C_{s2}$. The output across one of the MOSFET switches is used to provide an input to the LED lighting circuit. In this embodiment, output across nodes X, Y of MOSFET switch $S_2$ is used as an input to the LED lighting circuit. Node Y and the negative terminal of the voltage source $V_{dc}$ in this embodiment are connected to ground. A series inductor $L_r$ is arranged between the MOSFET switch $S_2$ and the LED lighting circuit.

In the embodiment of FIG. 10, input current $i_{in}$ is sampled by a microcontroller (not shown) through a current transformer $T_c$ and an associated transformer circuit. The transformer circuit in the present embodiment comprises a coupling load (resistor $R_c$), a low pass RC filter (which comprises a resistor $R_i$, a capacitor $C_i$, and a diode $D_c$) and a sensitivity control component (resistor $R_d$). In the present embodiment, only the positive half cycle of the voltage across the resistor $R_c$ flows through a low pass RC filter. On the other hand, resistor $R_d$ is used for discharging the capacitor $C_1$ and to improve the sensitivity of the control. The voltage across the resistor $R_d$, $v'_{in}=i'_{in}R_d$, is sampled by the microcontroller. Therefore, $v'_{in}$ is proportional to the magnitude of $i'_{in}$ in the present embodiment. Preferably, the microcontroller is operable to convert the sampled value of $v'_{in}$ into a corresponding current value using the formula $i'_{in}=v'_{in}/R_d$.

A person skilled in the art would appreciate that any other forms of current or voltage sampling circuits that is operable to determine the input current $i_{in}$ may be arranged in the driver circuit 1000 for sampling the input current $i_{in}$.

Although not specifically shown, in one embodiment, a controller such as a microcontroller chip may be arranged to be connected with the MOSFET switches $S_1$, $S_2$ so as to control the duty cycle and switching frequency of the switches $S_1$, $S_2$ and hence control and regulate the power (e.g. current $i_{in}$ or voltage $v_{in}$) provided to the LED lighting circuit. In one embodiment, such controller (for controlling the MOSFET switches) is preferably in connection with an input current $i_{in}$ sampling arrangement (e.g. the microcontroller of the transformer circuit) in the driver circuit 1000. In another embodiment, such controller (for controlling the MOSFET switches) is the same controller as the microcontroller of the transformer circuit. The details of the operation method of the driver circuit 1000 will be further described below with reference to FIG. 13.

Overall Equivalent Circuit

Figure 11:
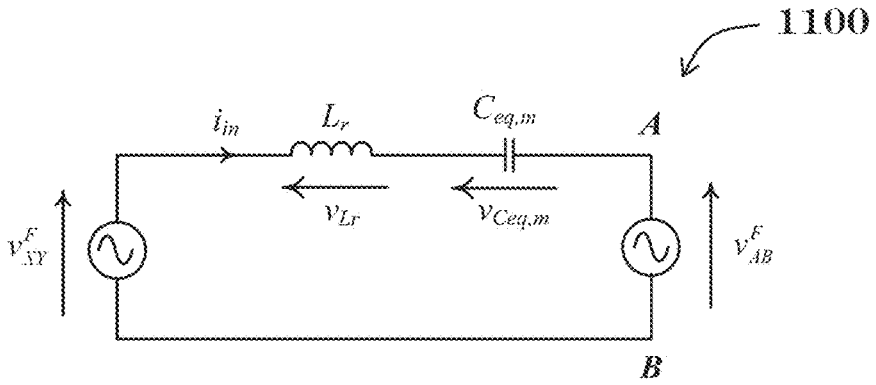
FIG. 11 shows an equivalent resonant circuit of an LED system comprising the LED lighting circuits of FIGS. 1-4 (with reference to the Thevenin's equivalent circuit model of FIGS. 9C-9D) and the driver circuit of FIG. 10.
Figure 12:
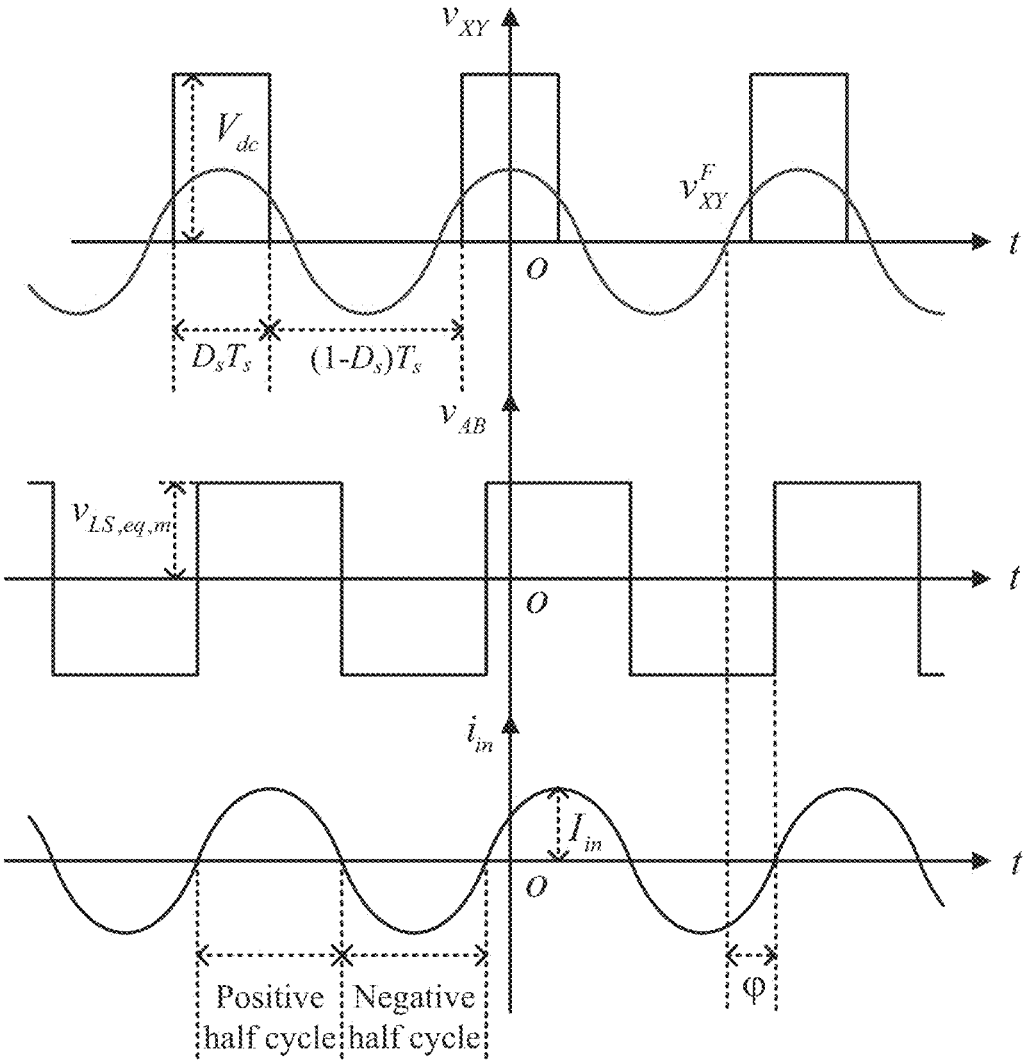
FIG. 12 shows the key waveforms presented in the equivalent circuit of FIG. 11.

FIG. 11 shows an equivalent resonant circuit 1100 of an LED system comprising any one of the LED lighting circuits 100, 200, 300, 400 of FIGS. 1-4 (with reference to the Thevenin's equivalent circuit model of FIGS. 9C-9D) and the driver circuit 1000 of FIG. 10. FIG. 12 shows the key waveforms $v_{XY}$, $v_{AB}$, $i_{in}$ in the circuit 1000, 1100 of FIGS. 10 and 11.

The following are provided to illustrate the relationships among the LED string current(s), the switching frequency of the MOSFET switches $S_1$, $S_2$, and duty cycle of the MOSFET switches $S_1$, $S_2$ in the embodiments of FIGS. 10-11.

As shown in FIG. 12, the waveform of voltage $v_{XY}$ is even symmetric and it has an amplitude $V_{dc}$. Based on Fourier analysis, the fundamental component of $v_{XY}$, $v_{XY}^F$ is $$v_{XY}^F(t) = V_{XY}^F\cos(\omega_s t) = \frac{2V_{dc}}{\pi}\sin(\pi D_s)\cos(\omega_s t) \quad (38)$$

where $$V_{XY}^F = \frac{2}{T_s}\int_{-\frac{T_s}{2}}^{\frac{T_s}{2}} v_{XY}(t)\cos(\omega_s t)\,dt = \frac{2V_{dc}}{\pi}\sin(\pi D_s), \text{ and } D_s$$

is the steady-state duty cycle of $S_1$.

Taking $v_{XY}^F$ as the reference phasor, $$v_{XY}^F = \frac{2V_{dc}}{\pi}\sin(\pi D_s) \quad (39)$$

As illustrated in FIG. 12, the input current $i_{in}$ lags $v_{XY}^F$ by a phase angle $\phi$. Thus, the equation of the input current as a function of time is $$i_{in}(t)=I_{in}\cos(\omega_s t-\phi) \quad (40)$$

where $I_{in}$ is the amplitude of total input current.

The voltage $v_{AB}$ in the circuits of FIGS. 9C and 9D is in phase with the current $i_{in}$. Based on Fourier analysis, the fundamental component of $v_{AB}$ ($v_{AB}^F$) is $$v_{AB}^F(t) = V_{AB}^F\cos(\omega_s t-\varphi) = \frac{4v_{LS,eq,m}}{\pi}\cos(\omega_s t-\varphi) \quad (41)$$

where $$V_{AB}^F = \frac{2}{T_s}\int_{-\frac{T_s}{2}}^{\frac{T_s}{2}} v_{AB}(t)\cos\omega_s t\,dt.$$

Based on the above analysis, it can be determined, for the circuit 1100 in FIG. 11, that $$v_{XY}^{F} = i_{in}\left(j\omega_s L_r + \frac{1}{j\omega_s C_{eq,m}}\right) + v_{AB}^{F} \tag{42}$$

By expressing $i_{in}$ and $v_{AB}^{F}$ in rectangular form, $$i_{in}=a_{in}+jb_{in} \tag{43}$$

$$v_{AB}^{F}=c+jd \tag{44}$$

Then, based on equations (40) and (43), $$I_{in} = \sqrt{a_{in}^2 + b_{in}^2} \tag{45}$$

$$\tan\varphi = \frac{b_{in}}{a_{in}} \tag{46}$$

based on equations (41) and (44), $$\frac{4v_{LS,eq,m}}{\pi} = \sqrt{c^2 + d^2} \tag{47}$$

$$\tan\varphi = \frac{d}{c} \tag{48}$$

based on equations (46) and (48), $$\frac{b_{in}}{a_{in}} = \frac{d}{c} \tag{49}$$

and based on equations (47) and (49)

$$c = \frac{4v_{LS,eq,m}}{\pi}\frac{a_{in}}{\sqrt{a_{in}^2 + b_{in}^2}} \tag{50}$$

$$d = \frac{4v_{LS,eq,m}}{\pi}\frac{b_{in}}{\sqrt{a_{in}^2 + b_{in}^2}} \tag{51}$$

By substituting equations (39), (43), (44), (50) and (51) into equation (42), it can be determined that $$\frac{2V_{dc}}{\pi}\sin(\pi D_s) = (a_{in} + jb_{in})\left(j\omega_s L_r + \frac{1}{j\omega_s C_{eq,m}} + \frac{4v_{LS,eq,m}}{\pi\sqrt{a_{in}^2 + b_{in}^2}}\right) \tag{52}$$

Furthermore, by equating the real and imaginary parts of the left side and right side of equation (52), it is determined that $$\frac{4v_{LS,eq,m}}{\pi\sqrt{a_{in}^2 + b_{in}^2}}a_{in} - \left(\omega_s L_r - \frac{1}{\omega_s C_{eq,m}}\right)b_{in} = \frac{2V_{dc}\sin(\pi D_s)}{\pi} \tag{53}$$

$$\left(\omega_s L_r - \frac{1}{\omega_s C_{eq,m}}\right)a_{in} + \frac{4v_{LS,eq,m}}{\pi\sqrt{a_{in}^2 + b_{in}^2}}b_{in} = 0 \tag{54}$$

Thus, by using equations (53) and (54), it is determined that $$\sqrt{a_{in}^2 + b_{in}^2} = \frac{2\sqrt{V_{dc}^2\sin^2(\pi D_s) - 4v_{LS,eq,m}^2}}{\pi\left(\omega_s L_r - \frac{1}{\omega_s C_{eq,m}}\right)} \tag{55}$$

In addition, the average current of LED string $LS_k$, $i_{LS,k}$, can be determined using equation (55).

Specifically, for the first and second embodiments (the circuits of FIGS. 1 and 2 respectively), the average LED string current $i_{LS,k}$ can be expressed as:

$$i_{LS,k} = \frac{1}{N\pi}\int_0^{\pi} i_{in}\, d\omega_s t = \frac{4\sqrt{V_{dc}^2\sin^2(\pi D_s) - 4v_{LS,eq,m}^2}}{N\pi^2\left(\omega_s L_r - \frac{1}{\omega_s C_{eq,m}}\right)} \tag{56}$$

And for the third and fourth embodiments (the circuits of FIGS. 3 and 4 respectively), the average LED string current $i_{LS,k}$ can be expressed as:

$$i_{LS,k} = \frac{1}{(N-1)\pi}\int_0^{\pi} i_{in}\, d\omega_s t = \frac{4\sqrt{V_{dc}^2\sin^2(\pi D_s) - 4v_{LS,eq,m}^2}}{(N-1)\pi^2\left(\omega_s L_r - \frac{1}{\omega_s C_{eq,m}}\right)} \tag{57}$$

Switching Frequency and Duty Cycle Control

In one embodiment of the present invention, the switching frequency and the duty cycle of the MOSFET devices $S_1$, $S_2$ in the driver circuit 1000 needs to be controlled for regulating the amount of power (e.g. current $i_{in}$, or voltage $v_{in}$) provided to the LED lighting circuit.

As shown in the above equations, all currents in the LED strings are balanced and therefore only $i_{in}$ is regulated in the LED circuit. In some embodiments, in order to dim the LED strings, the switching frequency and duty cycle of MOSFET switches $S_1$ and $S_2$ in the driver circuit 1000 are controlled. In some other embodiments where a wide dimming range is desired, it is preferred that the switching frequency and duty cycle of MOSFET switches $S_1$ and $S_2$ in the driver circuit 1000 are controlled at the same time.

Figure 13:
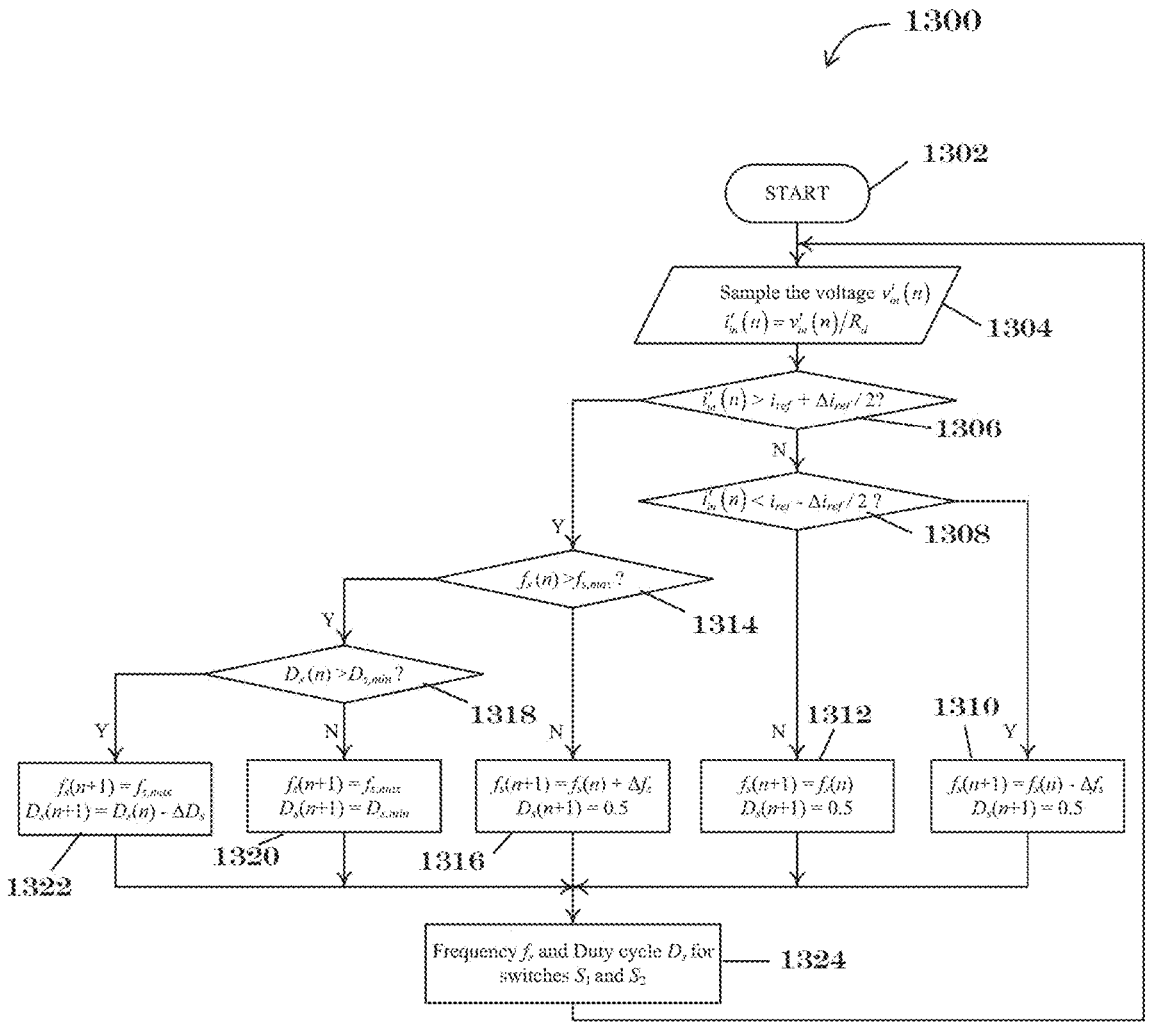
FIG. 13 is a flow chart illustrating a control method for controlling the total current in the LED system of FIG. 11.

FIG. 13 is a flow chart 1300 illustrating a method for controlling the switching frequency and duty cycle of switching elements in the driver circuits 1000 of FIG. 10 so as to effect dimming of the LEDs or LED strings in the LED lighting circuit (such as those as shown in FIGS. 1-4). In particular, in FIG. 13 there is provided a method for operating a driver circuit connected between a power source and a LED lighting circuit, the method comprising the steps of: determining a current flowing from the driver circuit to the LED lighting circuit; comparing the current determined with one or more predetermined values; and adjusting a switching frequency and/or a duty cycle of the switching devices of the driver circuit based on the comparison result so as to regulate power transmitted form the power source to the LED lighting circuit.

The following description with respect to the method illustrated in FIG. 13 is based on an exemplary embodiment that the method is implemented on the driver circuit 1000 of FIG. 10 which is driving any of the LED lighting circuits 100, 200, 300, 400 of FIGS. 1-4. A person skilled in the art would appreciate that any other driver circuits and LED lighting circuits may be controlled similarly using the principles of the method 1300 of FIG. 13.

The basic principle of the LED control method 1300 in the embodiment of FIG. 13 is based on that the LED string current is adjusted primarily by altering the switching frequency $f_s \in [f_{s,min}, f_{s,max}]$ of the MOSFET switches $S_1$, $S_2$. After the switching frequency $f_s$ of the MOSFET switches $S_1$, $S_2$ has reached a maximum value, i.e. the maximum switching frequency $f_{s,max}$, the duty cycle of the MOSFET switches $S_1$, $S_2$ will be reduced from 0.5 to a minimum steady-state duty cycle $D_{s,min}$. In the present embodiment, the default duty cycle value is 0.5. However, the default number may be any other number between 0 and 1 (0% -100%) in other embodiments.

Referring now to FIG. 13, the method 1300 begins from step 1302 in the first instance and then proceeds to step 1304. In step 1304, the input current $i_{in}$ is sampled to obtain a sampled current $i'_{in}(n)$, by sampling voltage $v'_{in}$ and using the formula $i'_{in}=v'_{in}/R_d$ as described with respect to FIG. 10.

In the present invention, the sampling process may be done periodically at regular or irregular time intervals, or may be continuous, by using a transformer circuit and microcontroller as shown and described with respect to FIG. 10, or any current or voltage sensor or sensing means arranged in the driver or LED lighting circuit for determining the input current $i_{in}$. In one embodiment, the sampled current $i'_{in}(n)$ is then transmitted back to the microprocessor or controller unit (associated with the MOSFET switches $S_1$, $S_2$) in the driver circuit 1000 by the current sensing means for further processing.

In step 1306, $i'_{in}(n)$ is compared with a upper current limit $i_{ref}+\Delta i_{ref}/2$, where $i_{ref}$ is the reference input current and $i'_{in}(n)$ is then bandwidth (which may be variable or predefined). If it is determined in step 1306 that the sampled current $i'_{in}(n)$ is below the upper current limit $i_{ref}+\Delta i_{ref}/2$, the method then proceeds to step 1308 in which the sampled current $i'_{in}(n)$ is compared with a lower limit $i_{ref}-\Delta i_{ref}/2$, where $i_{ref}$ is the reference input current and $\Delta i_{ref}$ is the bandwidth (which may be variable or predefined). In step 1308, if it is determined that the sampled current $i'_{in}(n)$ is above the lower current limit $i_{ref}-\Delta i_{ref}/2$, i.e. the sampled current $i'_{in}(n)$ is within the range defined by the upper and lower limits $i_{ref}+\Delta i_{ref}/2$ and $i_{ref}-\Delta i_{ref}/2$, then the method proceeds to step 1310, and the switching frequency in the next sampling cycle $f_s(n+1)$ will be set to $f_s(n)-\Delta f_s$ (by reducing the switching frequency in the present cycle by $\Delta f_s$, where $\Delta f_s$ is a predefined tolerance value) and the duty cycle in the next sampling cycle $D_s(n+1)$ will be set to 0.5 (50%). If, however, it is determined in step 1308 that the sampled current $i'_{in}(n)$ is below the lower current limit $i_{ref}-\Delta i_{ref}/2$, then the method proceeds to step 1312, in which the switching frequency in the next sampling cycle $f_s(n+1)$ will not be changed and the duty cycle in the next sampling cycle $D_s(n+1)$ will be set to or maintained at 0.5 (50%).

On the other hand, if it is determined in step 1306 that the sampled current $i'_{in}(n)$ is above the upper current limit $i_{ref}+\Delta i_{ref}/2$, the method proceeds to step 1314 in which the switching frequency $f_s(n)$ in the present sampling cycle is compared with the maximum switching frequency $f_{s,max}$. If it is determined in this step 1314 that the switching frequency $f_s(n)$ in the present sampling cycle is below the maximum switching frequency $f_{s,max}$, the method then proceeds to step 1316, where the switching frequency in the next sampling cycle $f_s(n+1)$ is increased to $f_s(n)+\Delta f_s$ (by increasing the switching frequency in the present cycle by $\Delta f_s$, where $\Delta f_s$ is a predefined tolerance value), and the duty cycle in the next sampling cycle $D_s(n+1)$ is set to or maintained at 0.5 (50%).

If it is determined in step 1314 that the switching frequency $f_s(n)$ at the present cycle is above the maximum switching frequency $f_{s,max}$, then the method proceeds to step 1318, and compares the duty cycle $D_s(n)$ in the present sampling cycle with the minimum duty cycle $D_{s,min}$. If it is determined in step 1318 that the duty cycle in the present sampling cycle is below the minimum duty cycle $D_{s,min}$, the method then proceeds to step 1320 to set the switching frequency in the next sampling cycle $f_s(n+1)$ to the maximum switching frequency $f_{s,max}$, and set the duty cycle in the next sampling cycle $D_s(n+1)$ to be the minimum duty cycle $D_{s,min}$. Alternatively, if it is determined in step 1318 that the duty cycle in the present sampling cycle is below the minimum duty cycle $D_{s,min}$, the method then proceeds to step 1322 to set the switching frequency in the next sampling cycle $f_s(n+1)$ to the maximum switching frequency $f_{s,max}$, and set the duty cycle in the next sampling cycle $D_s(n+1)$ to be $D_s(n)-\Delta D_s$ (by reducing the duty cycle in the present cycle by $\Delta D_s$, where $\Delta D_s$ is a predefined tolerance value).

In the present embodiment, after steps 1310, 1312, 1316, 1320 or 1322, the method 1300 then proceeds to step 1324 to set the switching frequency and the duty cycle for the next sampling cycle of the switching elements $S_1$, $S_2$ in the driver circuit 1000. The control method 1300 then loops back to step 1304 until the circuit is switched off.

In the above method 1300 illustrated in FIG. 13, $\Delta d_s$ and $\Delta f_s$ are predetermined values and the control sensitivity of the driver circuit will be increased when these two values are increased.

In the present embodiment, the minimum switching frequency $f_{s,min}$ is chosen so as to ensure soft-switching of the MOSFET switching units $S_1$, $S_2$. To achieve this effect, it would be necessary for $$f_{s,min} > f_r \tag{58}$$

where $f_r$ is the resonant frequency of whole system, $$f_r = \frac{1}{2\pi\sqrt{L_r C_{eq,m}}}.$$

In the present embodiment, it is possible to dim the LEDs or LED strings by increasing the switching frequency of the MOSFET switches $S_1$, $S_2$. However, the frequency could be very high at such dimmed power. In a preferred embodiment of the present invention, the maximum switching frequency $f_{s,max}$ is chosen to be less than three times the minimum switching frequency $f_{s,min}$ in the design. Other values may also be used for other embodiments, but then soft switching of the switches $S_1$, $S_2$ may not be possible in these embodiments.

In one embodiment, in order to extend the dimming range, the steady-state duty cycle $D_s$ is reduced after the switching frequency has reached a maximum $f_{s,max}$. Preferably, the minimum duty cycle $D_{s,min}$ is chosen to ensure soft-switching of the switching elements $S_1$, $S_2$. Thus, $$\varphi \geq \pi\left(\frac{1}{2} - D_s(t)\right) \tag{59}$$

Furthermore, based on equations (45), (46), (53) and (54), it can be determined that $$\varphi = \cos^{-1}\frac{2v_{LS,eq,m}}{V_{dc}\sin[\pi D_s(t)]} \tag{60}$$

and by using equations (59) and (60), it is found that $$D_{s,min} = \frac{1}{\pi}\sin^{-1}\sqrt{\frac{2v_{LS,eq,m}}{V_{dc}}} \tag{61}$$

Figure 14:
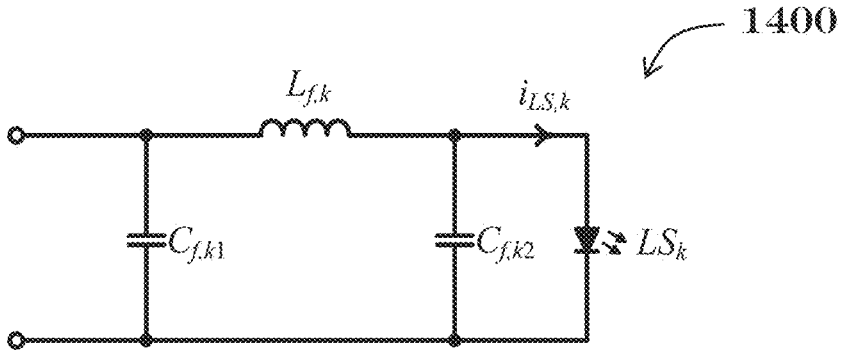
FIG. 14 shows an embodiment of a pi-filter for the LED strings of FIGS. 1-4.

FIG. 14 shows an embodiment of a pi-filter 1400 for the LED strings of FIGS. 1-4. In one embodiment of the present invention, each of the LED string in the LED lighting circuits 100, 200, 300, 400 in FIGS. 1-4 are coupled with a pi-filter, i.e. a CLC circuit consisting of the inductor $L_{f,k}$ and two capacitors $C_{f,k1}$ and $C_{f,k2}$. It would be appreciated that the pi-filter 1400 is not absolutely necessary for each of the LED strings in the LED lighting circuits 100, 200, 300, 400, but the inclusion of such filter 1400 with the LED strings would generally improve the performance of the LED systems or circuits in FIGS. 1-4 by stabilizing the currents through individual LED strings.

Figure 15A:
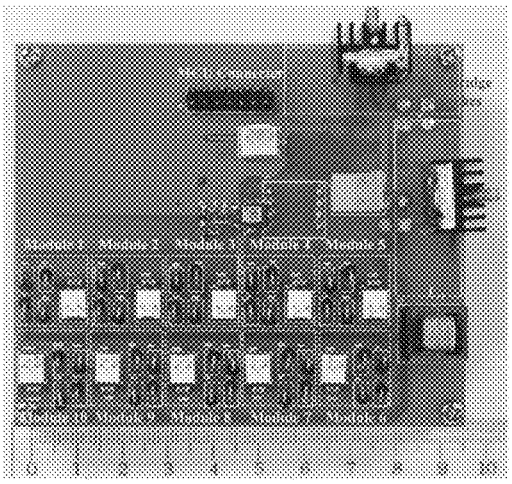
FIG. 15A is a top view of a prototype of an 80 W LED driver circuit in accordance with one embodiment of the present invention.
Figure 15B:
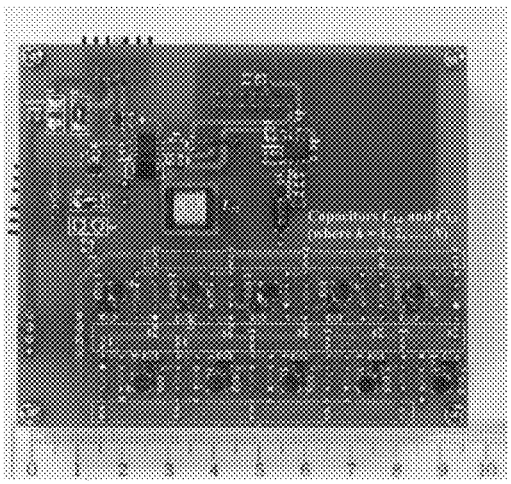
FIG. 15B is a bottom view of the prototype driver circuit of FIG. 16A.
Figure 15C:
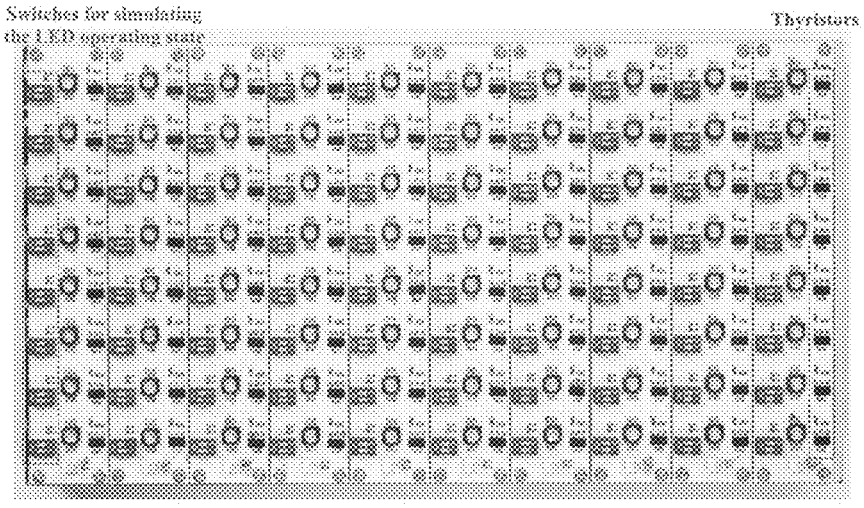
FIG. 15C shows a prototype of a LED board built with 10 LED strings, thyristors, and switches in accordance with one embodiment of the present invention.

FIGS. 15A-15C show a prototype of an 80 W LED driving circuit 1500A, 1500B (FIGS. 15A-15B) and a prototype of a LED board 1500C (FIG. 15C) built with 10 LED strings, thyristors, and switches in accordance with one embodiment of the present invention. In this embodiment, the prototype circuits in FIGS. 15A-15C are designed and built based on the driver circuit 1000 illustrated in FIG. 10 as well as the LED lighting circuit 100 in FIG. 1. However, it would be appreciated that other prototypes may be built with the driver circuit 1000 and LED lighting circuits 200, 300, 400 in FIGS. 2-4 illustrated in the present invention. The design procedure of the prototype circuits in accordance with one embodiment of the present invention is described as follows.

Taking the LED lighting circuit 100 embodiment in FIG. 1 as an example, the values $L_r$ (e.g. coupling inductor in the driver circuit in FIG. 10), $C_{1k}$ and $C_{2k}$ (e.g. first and second capacitors in FIG. 1), $L_{fk}$, $C_{f,k1}$ and $C_{f,k2}$ (e.g. capacitors and inductor in the CLC circuit in FIG. 14) in this embodiment is designed based on following parameters, the are $v_{LS}$: typical value of the string voltage; $i_{LS}$: average LED string current at rated condition; $V_{dc}$: supply source voltage; $f_{s,min}$: minimum switching frequency of $S_1$ and $S_2$; $\Delta i_{L_{f,k}}$: peak-to-peak ripple current on $L_{f,k}$ at rated condition; $\Delta v_{max}$: maximum peak-to-peak ripple voltage on $C_{f,k1}$ at rated condition; N: number of LED strings; and $f_c$: cut off frequency of output low pass filter $L_{f,k}$ and $C_{f,k2}$.

In the present embodiment, the design procedure involves 2 main steps:

Step 1—Determination of the values of $L_r$ $C_{1k}$ and $C_{2k}$

In order to realize soft-switching, assuming that the switching frequency is 1.3 times of the resonant frequency of equivalent circuit (power source+driver circuit+LED lighting circuit, such as the circuit 1100 in FIG. 11):

$$f_{s,min}=1.3f_r \tag{62}$$

where $$f_r = \frac{1}{2\pi\sqrt{\frac{N}{2}L_rC}}$$

for the circuit in FIG. 1.

Based on equations (56) and (62), the values of $L_r$, $C_{1k}$ and $C_{2k}$ can be determined by $$C_{1k} = C_{2k} = C = \frac{69\pi i_{LS}}{400\ f_{s,min}\sqrt{V_{dc}^2 - 4v_{LS}^2}} \tag{63}$$

$$L_r = \frac{0.845}{N\pi^2 f_{s,min}^2 C} \tag{64}$$

Step 2—Determination of the values of $L_{f,k}$, $C_{f,k1}$ and $C_{f,k2}$

In this step, the fundamental frequency component is considered. Assuming that all ripple current in the output goes to the output capacitor $C_{f,k1}$, $C_{f,k1}$ can be determined as $$\begin{aligned} C_{f,k1} &= \frac{1}{\Delta v_{max}}\int_{\theta/\omega_s}^{(\pi-\theta)/\omega_s}\left(\frac{\pi}{2}i_{LS}\sin\omega_s t - i_{LS}\right)dt \\ &= \frac{i_{LS}}{2\pi f_{s,min}\Delta v_{max}}[\pi\cos\theta - (\pi - 2\theta)] \end{aligned} \tag{65}$$

where $\theta=\sin^{-1}(2/\pi)$.

In this embodiment, the value of $L_{f,k}$ is designed by considering the ripple current $\Delta i_{L_{f,k}}$ through it. Moreover, the voltage across $L_{f,k}$ is the same as the voltage ripple $\Delta v_{max}$ across $C_{f,k1}$. Accordingly, $L_{f,k}$ can be determined as $$L_{f,k}\frac{\Delta i_{L_{f,k}}}{\Delta t} = \Delta v_{max} \Rightarrow L_{f,k} \cong \frac{\Delta v_{max}}{2\pi f_{s,min}\Delta i_{L_{f,k}}} \tag{66}$$

On the other hand, the value of $C_{f,k2}$ in this embodiment is obtained by considering the cut-off frequency $f_c$ of the filter formed by $L_{f,k}$ and $C_{f,k2}$. Thus, $C_{f,k2}$ can be determined as $$C_{f,k2} = \frac{1}{4\pi^2 f_c^2 L_{f,k}} \tag{67}$$

A person skilled in the art would appreciate that this design method can be used for designing different embodiments of LED driving and/or lighting circuits of the present invention having different configurations.

Referring back to FIGS. 15A-15C, the 80 W prototype driver 1500A, 1500B and LED lighting circuits 1500C is built based on the design procedures described above, with 10 LED strings in the LED board, where each string includes 8 LEDs. The design specification of the prototype is shown in the table in FIG. 21, and the value and part numbers of the components used in this particular circuit design is shown in FIG. 22. The table in FIG. 27 shows the capacitance values of the capacitors used in the prototype of FIGS. 15A-15C.

FIGS. 15A-15B show the prototype driver 1500A, 1500B for driving the LED lighting circuit 1500C. FIGS. 15A and 15B show the top and bottom views of the driver prototype respectively. As shown in the Figures, the prototype includes a half wave bridge switches comprising MOSFET switches, an MCU controller arranged to control the half wave bridge switches, as well as the various capacitor-diode network of FIG. 1 (without the LEDs). FIG. 15C shows an LED board 1500C consisting of LEDs, thyristors for providing the bypass path when LED is faulty (i.e. open-circuited), and switches for simulating three LED operating states (i.e. normal, short and open states). The LED board 1500C in FIG. 15C can be readily connected to the capacitor-diode network of the driver unit 1500A, 1500B in FIGS. 15A-15B utilizing proper conductive connections and links.

The prototype circuits of FIGS. 15A-15C are tested (by connecting the LED board 1500C of FIG. 15C with the driver board 1500A, 1500B of FIGS. 15A-15B) for verifying the performance of the proposed current-balancing circuit in one embodiment of the present invention.

Figure 16A:
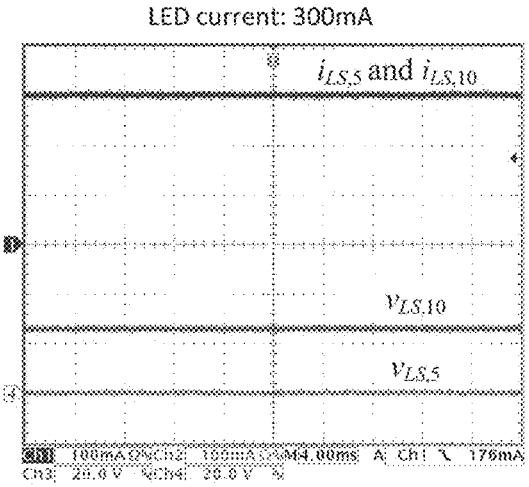
FIG. 16A shows the voltage and current waveforms of two of the \LED strings (LED string #5 and #10) in the prototype circuit of FIGS. 16A-16C during experimentation when the LED current is 300 mA.
Figure 16B:
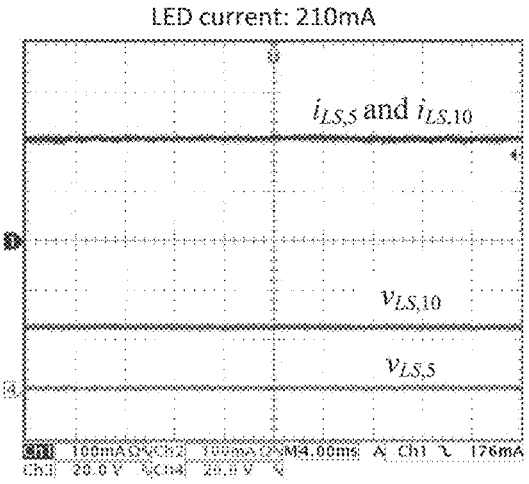
FIG. 16B shows the voltage and current waveforms of two of the LED strings (LED string #5 and #10) in the prototype circuit of FIGS. 16A-16C during experimentation when the LED current is 210 mA.
Figure 16C:
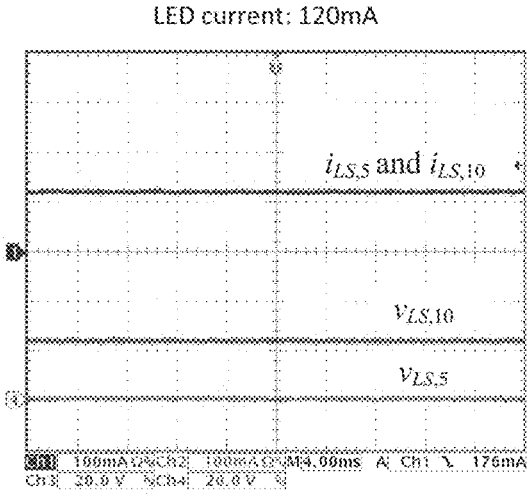
FIG. 16C shows the voltage and current waveforms of two of the LED strings (LED string #5 and #10) in the prototype circuit of FIGS. 16A-16C during experimentation when the LED current is 120 mA.
Figure 16D:
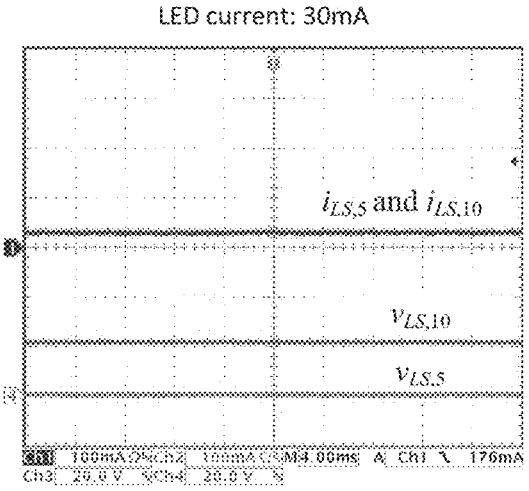
FIG. 16D shows the voltage and current waveforms of two of the LED strings (LED string #5 and #10) in the prototype circuit of FIGS. 16A-16C during experimentation when the LED current is 30 mA.

FIGS. 16A-16D show the voltage and current waveforms in LED string #5 and LED string #10 when the prototype in FIGS. 15A-15C is tested during operation. In FIG. 16A, the LED current is 300 mA; in FIG. 16B, the LED current is 210 mA; in FIG. 16C, the LED current is 120 mA; and in FIG. 16D, the LED current is 30 mA. As shown in FIGS. 16A-16D, the currents in these two LED strings are very close at different current levels even if string #5 is short circuited (i.e., 0V) and string #10 is in normal condition.

The tables in FIGS. 23-26 correspond to the results in FIGS. 16A-16D and they show the current $i_{LS}$ in each LED string, the variation of the string current from the average value, the voltage $v_{LS}$ of each LED string, and the variation of the string voltage from the nominal value under different LED string currents. As shown in these tables, the variation of the string currents has a low dependency on the variation of the string voltage and values of capacitance of the capacitors.

Figure 17:
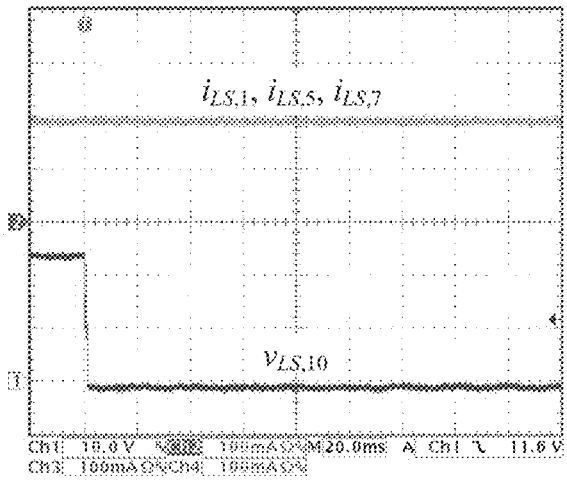
FIG. 17 shows the transient voltage and current waveforms of some of the LED strings (current waveform of LED strings #1, 5 and 7; voltage waveform of LED string #10) in the prototype circuit of FIGS. 16A-16C during experimentation when one of the LED string (LED string #10) suddenly fails.

FIG. 17 shows the transient voltage and current waveforms of some of the LED strings (current waveforms of LED strings #1, 5 and 7; voltage waveform of LED string #10) in the prototype circuit of FIGS. 15A-15C during the test operation when one of the LED string (LED string #10) suddenly fails. As shown in FIG. 17, the currents through the LED strings #1, 5 and 7 are substantially unaffected by the failed LED string #10.

Figure 18A:
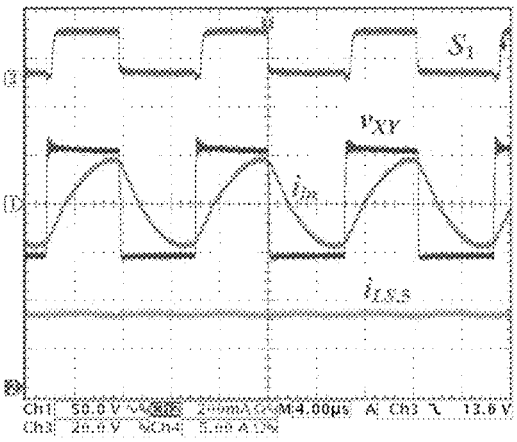
FIG. 18A shows the key current and voltage waveforms of the prototype circuit of FIGS. 16A-16C during operation when the LED current is 300 mA.
Figure 18B:
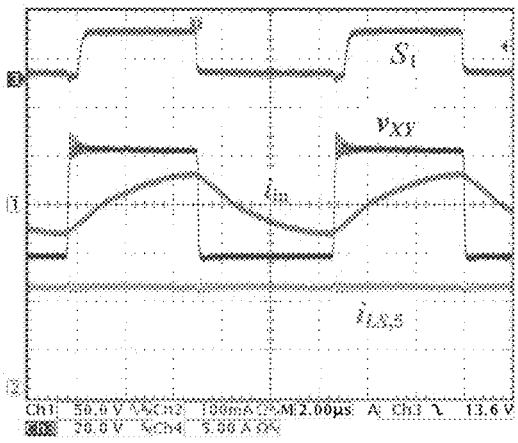
FIG. 18B shows the key current and voltage waveforms of the prototype circuit of FIGS. 16A-16C during operation when the LED current is 210 mA.
Figure 18C:
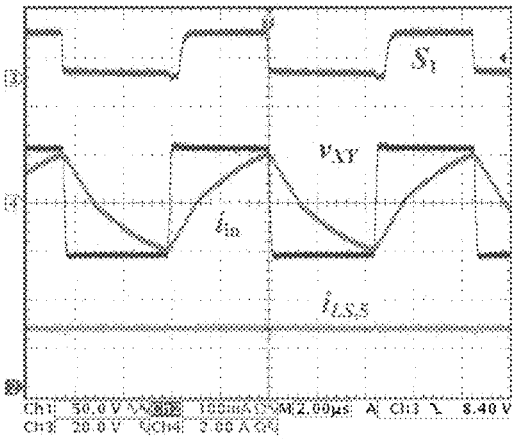
FIG. 18C shows the key current and voltage waveforms of the prototype circuit of FIGS. 16A-16C during operation when the LED current is 120 mA.
Figure 18D:
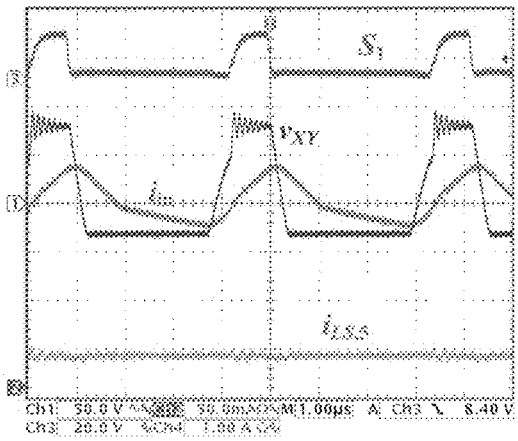
FIG. 18D shows the key current and voltage waveforms of the prototype circuit of FIGS. 16A-16C during operation when the LED current is 30 mA.

FIGS. 18A-18D show the key current and voltage waveforms of the prototype circuit of FIGS. 15A-15C during test operation when the LED current is 300 mA, 210 mA, 120 mA, and 30 mA respectively. In the result of FIGS. 18A-18C, only the switching frequency of the switching elements (MOSFET elements) in the driver circuit 1500A, 1500B is changed to reduce the LED string current for dimming. In FIG. 18D, the switching frequency and duty cycle of the switching elements (MOSFET elements) are all changed when the LED string current is reduced to 10% of the original value for dimming.

The waveforms shown in FIGS. 18A-18D show that the input current $i_{in}$ always lags behind the voltage $v_{XY}$. This indicates that the half bridge switches (MOSFET elements) in the driver circuit are always soft-switched.

Figure 19:
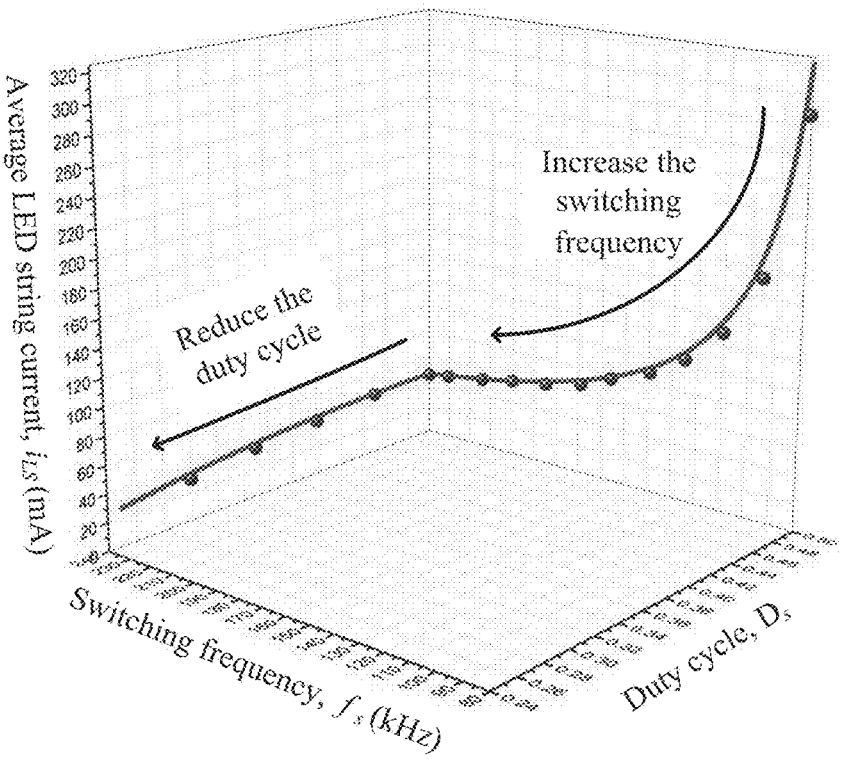
FIG. 19 is a plot showing the theoretical and experimental variation of the average LED string current $i_{LS}$ against the duty cycle and switching frequency of the half bridge switches (MOSFET elements)

FIG. 19 shows a three-dimensional plot of the variation of the average LED string current $i_{LS}$ against the duty cycle $D_s$ and switching frequency $f_s$ of the half bridge switches (MOSFET elements). In the Figure, the theoretical curve is obtained by using equation (56). On the other hand, the LED string current $i_{LS}$ is determined by both the switching frequency and duty cycle of the switching elements in the driver circuit. As shown in FIG. 19, the experimental results (in dots) are found to be in close agreement with the theoretical curve.

Figure 20:
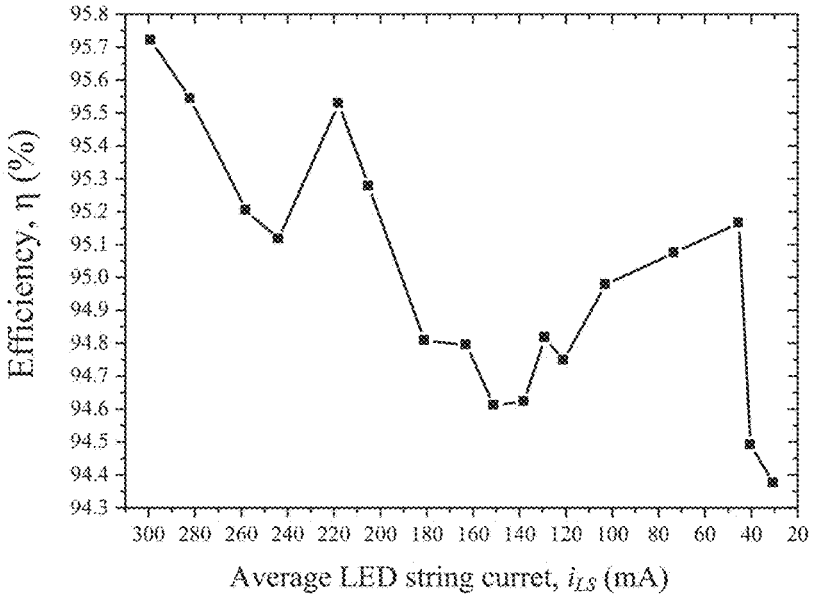
FIG. 20 is a plot showing the overall efficiency versus an average LED string current $i_{LS}$ obtained using the prototype circuit of FIGS. 16A-16C.

FIG. 20 shows the efficiency versus average LED string current $i_{LS}$. In this Figure, the efficiency is calculated from the input of the driver to the output strings in the prototype of FIGS. 15A-15C during test operation. It can be seen from FIG. 20 that the efficiency is about 95% throughout the operating range from 100% to 10% of the rated power (rated power is 300 mA).

Referring to the above description, a person skilled in the art would readily appreciate that the term "LED" used may refer to any kind of semi-conductive light source, of any colour and size, without deviating from the scope of the present invention.

The embodiments in the present invention provide a LED lighting circuit in which the currents through two adjacently connected LED strings are balanced by a simple diode-capacitor network. The present invention also provides a driver circuit for regulating power supplied to the LED lighting circuit, as well as a method for operating the driver circuit for controlling the brightness of the LEDs effectively and efficiently. The embodiments in the present invention present a number of unique advantages.

By applying the charge-balance property of capacitors in the present invention, each capacitor in the LED lighting circuit is firstly charged through one LED string and is then discharged through the adjacent LED string. Thus, for a lighting equipment such as a lamp having a LED lighting circuit of the present invention with N LED strings, there are N diode-capacitor networks. Advantageously, all diode-capacitor networks are connected in a closed loop, and the above-mentioned charging and discharging mechanism propagates throughout the whole loop to achieve robust current balancing function.

In addition, the diode-capacitor circuit architecture in the embodiments of the present invention provides two distinctive current paths, an AC current path and a DC current path. In particular, the AC current in the AC current path only flows through the capacitors, while the DC current in the DC current path flows through the LED strings. In embodiments of the invention, the AC current is converted into the DC current through a rectification circuit such as a diode bridge or a diode. In the present invention, since the AC current has the same charge transfer in the positive and negative cycle respectively, the DC current can be balanced, irrespective to the LED string voltage and the value of capacitance of the capacitors.

The circuit architecture provided in the present invention has a relatively simple structure, and is modular and scalable. In other words, more LEDs or LED strings may be readily added to the circuit, or excess LEDs or LED strings may be readily removed. In the present invention, the current-balancing property of the circuit is substantially independent from the LED string voltages and the capacitance values of the capacitors. By utilizing a capacitive arrangement between the LED string-diode (or diode bridge) loop and the nodes connected with the power supply (provided, for example, by the driver circuit), a galvanic isolation can be provided between the driver and the strings. In the present invention, the current flow in the circuit is substantially unaffected (remain balanced) by any LED light elements or LED strings that may fail or becomes faulty during operation.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. An LED lighting circuit comprising:

a first node and a second node, the first and second nodes being adapted to couple with an AC input power source and a driver circuit; and an LED circuit loop having a plurality of LED light strings each having one or more LED light elements, the LED circuit loop defining a closed loop arranged between the first node and the second node and is connected to the first node and the second node respectively through a capacitive arrangement such that the LED light strings in the LED circuit loop is arranged to be driven with DC power while AC power provided by the AC input power source is transmitted between the first and second nodes, wherein the LED circuit loop further comprises a plurality of rectifier circuits connected in series with the plurality of LED light strings, the rectifier circuit comprises a diode bridge, and wherein at least one LED light string is connected between two adjacent diode bridges in the LED circuit loop.

2. An LED lighting circuit in accordance with claim 1, wherein the capacitive arrangement is arranged to provide galvanic isolation to the LED circuit loop such that the LED circuit loop is galvanically isolated from the first and second nodes.

3. An LED lighting circuit in accordance with claim 1, wherein the capacitive arrangement comprises:

a plurality of first capacitors connected in parallel between the first node and the LED circuit loop; and a plurality of second capacitors connected in parallel between the second node and the LED circuit loop.

4. An LED lighting circuit in accordance with claim 3, wherein the plurality of first capacitors and the plurality of second capacitors are arranged to be charged and discharged alternately through the LED light strings as AC power is transmitted between the first and second nodes.

5. An LED lighting circuit in accordance with claim 4, wherein each of the plurality of first capacitors and each of the plurality of second capacitors are arranged to be charged and discharged alternately through different LED light strings in the LED lighting circuit as AC power provided by the AC input power source is transmitted from the first node to the second node and from the second node to the first node.

6. An LED lighting circuit in accordance with claim 1, further comprising a bypass element connected across one or more of the LED light elements to provide a bypass path when the one or more LED light element fails.

7. An LED lighting circuit in accordance with claim 6, wherein the bypass element comprises a thyristor.

8. An LED lighting circuit in accordance with claim 1, further comprising a filter circuit connected across one or more of the LED light strings to reduce current ripple in the one or more LED light strings.

9. An LED lighting circuit in accordance with claim 8, wherein the filter circuit comprises a capacitor-input filter.

10. An LED lighting circuit in accordance with claim 1, wherein the AC power provided by the AC input power source comprises an AC current with positive and negative half cycles.

11. An LED lighting circuit in accordance with claim 3, wherein each of the plurality of first capacitors is connected between the first node and a respective diode bridge; and each of the plurality of second capacitors is connected between the second node and a respective diode bridge, such that each diode bridge is coupled with the first node through a respective one of the plurality of first capacitors and with the second node through a respective one of the plurality of second capacitors.

12. An LED lighting circuit in accordance with claim 11, wherein a plurality of first flow paths are defined from the first node to the second node during positive half cycle of the AC power provided by the AC input power source, and a plurality of second flow paths are defined from the second node to the first node during a negative half cycle of the AC power provided by the AC input power source.

13. An LED lighting circuit in accordance with claim 12, wherein the plurality of first and second flow paths are arranged to power the LED light strings in the LED circuit loop as AC power is transmitted between the first and second nodes.

14. An LED lighting circuit in accordance with claim 13, wherein each LED light string is powered by a respective one of the plurality of first capacitors and a respective one of the plurality of second capacitors as AC power is transmitted from the first node to the second node, and is powered by another respective one of the plurality of first capacitors and another respective one of the plurality of second capacitors in the second flow path as AC power is transmitted from the second node to the first node.

15. An LED lighting circuit in accordance with claim 14, wherein each of the first flow path is defined from the first node, through a respective one of the plurality of first capacitors, a diode bridge connected directly with the respective one of the plurality of first capacitors, at least one LED light string connected between the diode bridge and an adjacent diode bridge, the adjacent diode bridge, a respective one of the plurality of second capacitors connected directly with the adjacent diode bridge, to the second node.

16. An LED lighting circuit in accordance with claim 14, wherein each of the second flow path is defined from the second node, through a respective one of the plurality of second capacitors, a diode bridge connected directly with the respective one of the plurality of second capacitors, at least one LED light string connected between the diode bridge and an adjacent diode bridge, the adjacent diode bridge, a respective one of the plurality of first capacitors connected directly with the adjacent diode bridge, to the first node.

17. An LED lighting circuit comprising:

a first node and a second node, the first and second nodes being adapted to couple with an AC input power source and a driver circuit; and an LED circuit loop having a plurality of LED light strings each having one or more LED light elements, the LED circuit loop defining a closed loop arranged between the first node and the second node and is connected to the first node and the second node respectively through a capacitive arrangement such that the LED light strings in the LED circuit loop is arranged to be driven with DC power as AC power provided by the AC input power source is transmitted between the first and second nodes, wherein the LED circuit loop further comprises a plurality of rectifier circuits connected in series with the plurality of LED light strings, wherein the rectifier circuit comprises a diode, wherein at least one LED light string is connected between two adjacent diodes in the LED circuit loop, wherein the capacitive arrangement comprises:

a plurality of first capacitors connected in parallel between the first node and the LED circuit loop; and a plurality of second capacitors connected in parallel between the second node and the LED circuit loop, wherein each of the plurality of first capacitors is connected between the first node and a respective diode, and each of the plurality of second capacitors is connected between a respective diode and the second node; wherein each diode is connected directly with only one of the plurality of first capacitors or one of the plurality of second capacitors but not to both.

18. An LED lighting circuit in accordance with claim 17, wherein a plurality of first flow paths are defined from the first node to the second node during positive half cycle of the AC power provided by the AC input power source, and a plurality of second flow paths are defined from the second node to the first node during a negative half cycle of the AC power provided by the AC input power source.

19. An LED lighting circuit in accordance with claim 18, wherein each of the first flow path is defined from the first node, through a respective one of the plurality of first capacitors, a diode connected directly with the respective one of the plurality of first capacitors, at least one LED light string connected to the diode, a respective one of the plurality of second capacitors connected directly with the at least one LED light string, to the second node.

20. An LED lighting circuit in accordance with claim 18, wherein each of the second flow path is defined from the second node, through a respective one of the plurality of second capacitors, a diode connected directly with the respective one of the plurality of second capacitors, at least one LED light string connected to the diode, a respective one of the plurality of first capacitors connected directly with the at least one LED light string, to the first node.

21. An LED lighting circuit in accordance with claim 18, wherein a third flow path is defined from the first node to the second node, through one of the plurality of first capacitors, a diode connected directly with the one of the plurality of first capacitors, at least one LED light string, another diode connected to the at least one LED light string, at least one another LED light string connected to the another diode, and one of the plurality of second capacitors connected directly with the at least one another LED light string.

22. An LED lighting circuit in accordance with claim 18, wherein a fourth flow path is defined from the second node to the first node, through one of the plurality of second capacitors, a diode connected directly with the one of the plurality of second capacitors, at least one LED light string connected with the diode, another diode connected to the at least one LED light string, at least one another LED light string connected to the another diode, and one of the plurality of first capacitors connected directly with the at least one another LED light string.

23. An LED lighting circuit in accordance with claim 1, wherein currents in each of the LED light string are balanced during operation of the LED lighting circuit such that the currents are of the same value.

24. An LED lighting circuit in accordance with claim 1, wherein the driver circuit is connected between a power source and the LED circuit loop for providing the AC input power source, and the driver circuit comprises one or more switching devices adapted to be connected in series with the power source, and an output across one of the one or more switching devices is arranged to act as an input to the LED circuit loop.

25. An LED lighting circuit in accordance with claim 24, wherein the driver circuit further comprises a series inductor connected between one of the switching devices and the LED circuit loop.

26. An LED lighting circuit in accordance with claim 24, wherein each of the one or more switching devices is connected with a parallel capacitor and/or a parallel diode.

27. An LED lighting circuit in accordance with claim 24, wherein the driver circuit further comprises an input current determination means arranged to determine the amount of current transmitted into the LED circuit loop.

28. An LED lighting circuit in accordance with claim 27, wherein the driver circuit further comprises a controller connected with the one or more switching devices for controlling a switching frequency and/or a duty cycle of the one or more switching devices based on the amount of current determined by the input current determination means so as to alter an amount of power provided to the LED circuit loop.

29. An LED lighting circuit in accordance with claim 28, wherein the controller comprises a microprocessor.

30. An LED lighting circuit in accordance with claim 24, wherein the switching devices are MOSFET devices.

31. An LED lighting circuit in accordance with claim 24, wherein the power source is a DC power source.

32. An LED lighting circuit in accordance with claim 28, wherein the driver circuit is arranged to:

determine a current flowing from the driver circuit to the LED circuit loop using an input current determination means arranged in the driver circuit;

compare the current determined with one or more predetermined values; and adjust a switching frequency and/or a duty cycle of the switching devices of the driver circuit based on the comparison result so as to regulate power transmitted form the power source to the LED circuit loop.

* * * * *